US008646374B2

(12) United States Patent
Shacklee et al.

(10) Patent No.: US 8,646,374 B2
(45) Date of Patent: Feb. 11, 2014

(54) WEAPON STATION AND ASSOCIATED METHOD

(75) Inventors: Frank L. Shacklee, Whitesboro, TX (US); Robert J. Bennett, Allen, TX (US); Michael D. Ernest, Garland, TX (US)

(73) Assignee: Raytheon Company, Waltham, MA (US)

( * ) Notice: Subject to any disclaimer, the term of this patent is extended or adjusted under 35 U.S.C. 154(b) by 210 days.

(21) Appl. No.: 13/190,259

(22) Filed: Jul. 25, 2011

(65) Prior Publication Data

US 2012/0024143 A1 Feb. 2, 2012

Related U.S. Application Data

(60) Provisional application No. 61/368,204, filed on Jul. 27, 2010.

(51) Int. Cl.
*F41A 27/00* (2006.01)
*F41G 5/00* (2006.01)

(52) U.S. Cl.
USPC ..... 89/41.02

(58) Field of Classification Search
USPC ..... 89/37.01, 41.02, 41.05, 41.07, 41.14, 89/41.15, 41.22
See application file for complete search history.

(56) References Cited

U.S. PATENT DOCUMENTS 2,569,571 A * 10/1951 Tear et al. ..... 89/41.12
2,660,794 A * 12/1953 Goertz et al. ..... 89/205
3,685,159 A * 8/1972 Erhard ..... 89/204
5,123,327 A * 6/1992 Alston et al. ..... 89/1.813
5,197,691 A * 3/1993 Amon et al. ..... 244/3.13
5,992,292 A * 11/1999 Ennenga ..... 89/41.22
6,769,347 B1 8/2004 Quinn ..... 89/41.05
7,487,705 B2 * 2/2009 Persson et al. ..... 89/41.02

(Continued)

FOREIGN PATENT DOCUMENTS

DE 43 06 913 8/1998 ..... F41G 5/08
EP 1 923 657 5/2008 ..... F41G 3/16

(Continued)

OTHER PUBLICATIONS

PCT, Notification of Transmittal of the International Search Report and the Written Opinion of the International Searching Authority, or the Declaration, International Application No. PCT/US2011/045276, International Filing date Aug. 26, 2011, (13 pages), Mailing date Oct. 18, 2011.

*Primary Examiner* — Bret Hayes
(74) *Attorney, Agent, or Firm* — Renner, Otto, Boisselle & Sklar, LLP

(57) ABSTRACT

In certain embodiments, a weapon station comprises a weapon mounting apparatus and a sight mounting apparatus. The weapon mounting apparatus is adapted to rotate, using a first rotational drive mechanism, about an azimuth axis. The weapon mounting apparatus is adapted to receive one or more weapons for attachment at a position offset from the azimuth axis. The sight mounting apparatus is coupled to the weapon mounting apparatus and is adapted to receive for attachment a sighting device. The sighting device comprises one or more sensors and is adapted to rotate, using a second rotational drive mechanism, the one or more sensors about the azimuth axis independently of rotational movement of the weapon mounting apparatus about the azimuth axis. The azimuth axis about which the weapon mounting apparatus and the one or more sensors rotate is a common azimuth axis.

12 Claims, 16 Drawing Sheets

(56) References Cited

U.S. PATENT DOCUMENTS

| | | | | |
|---|---|---|---|---|
| 7,600,462 | B2 | 10/2009 | Quinn | 89/41.08 |
| 7,870,816 | B1 | 1/2011 | Willingham et al. | 89/204 |
| 2004/0050240 | A1* | 3/2004 | Greene et al. | 89/41.06 |
| 2007/0204745 | A1* | 9/2007 | Son et al. | 89/27.3 |
| 2007/0208459 | A1 | 9/2007 | Choi | 700/245 |
| 2007/0209501 | A1 | 9/2007 | Ko | 89/40.01 |
| 2008/0034954 | A1* | 2/2008 | Grober | 89/41.05 |

FOREIGN PATENT DOCUMENTS

| | | | |
|---|---|---|---|
| EP | 2 133 647 | 12/2009 | F41A 23/24 |
| EP | 2 306 137 | 4/2011 | F41G 1/40 |
| WO | WO 2007/086874 | 8/2007 | H04N 3/16 |

* cited by examiner

WEAPON STATION AND ASSOCIATED METHOD

RELATED APPLICATION

This application claims the benefit under 35 U.S.C. §119 (e) of the priority of U.S. Provisional Application Ser. No. 61/368,204, filed Jul. 27, 2010, entitled "Weapon Station," incorporated herein by reference in its entirety.

BACKGROUND

Entities such as fixed structures and vehicles may be fitted with turret mounted guns. For example, military vehicles, such as tanks, armored personnel carriers, and the like are often fitted with turret mounted guns for protection of the military vehicle and its occupants and for other suitable purposes. The turret mounted gun typically includes a weapon, such as a machine gun that may be rotated about an azimuthal extent to fire upon enemies or other potential threats to the safety of the military vehicle or other entities.

SUMMARY

In certain embodiments, a weapon station comprises a weapon mounting apparatus and a sight mounting apparatus. The weapon mounting apparatus is adapted to rotate, using a first rotational drive mechanism, about an azimuth axis. The weapon mounting apparatus is adapted to receive one or more weapons for attachment at a position offset from the azimuth axis. The sight mounting apparatus is coupled to the weapon mounting apparatus and is adapted to receive for attachment a sighting device. The sighting device comprises one or more sensors and is adapted to rotate, using a second rotational drive mechanism, the one or more sensors about the azimuth axis independently of rotational movement of the weapon mounting apparatus about the azimuth axis. The azimuth axis about which the weapon mounting apparatus and the one or more sensors rotate is a common azimuth axis.

Certain embodiments of the present disclosure may provide one or more technical advantages. For example, the independent rotation of the weapon mounting apparatus and the one or more sensors of a sighting device about a common azimuth axis may allow independent establishment of an azimuth orientation of both one or more weapons attached to the weapon mounting apparatus and the one or more sensors of the sighting device. As another example, the independent rotation of the weapon mounting apparatus and the one or more sensors of a sighting device about different elevation axes may allow independent establishment of an elevational orientation of both one or more weapons attached to the weapon mounting apparatus and the one or more sensors of the sighting device. As another example, certain embodiments may allow the elevational orientation of one or more weapons and one or more sensors to be established both independently of one another (about different elevation axes), as well as the independent establishment of an azimuth orientation of one or more weapons and one or more sensors.

As just one example scenario, a sighting device may be able to rotate its one or more sensors about both the common azimuth axis and its own elevation axis as sighting device searches for potential targets, while the one or more weapons attached to the weapon mounting apparatus remain fixed in a stowage position. This may allow the weapon station to avoid pointing weapons at unintended targets or may allow the sighting device to search for targets in a more discrete manner.

In certain embodiments, the offset position of the attached weapons from the common azimuth axis may provide one or more advantages. For example, the offset position of the weapon may reduce or eliminate obstruction of the line-of-sight of the one or more sensors of the sighting device by the attached weapons. As another example, the offset position of the one or more attached weapons may provide a relatively smaller footprint or keep-out-zone to the weapon station than would otherwise be provided by a weapon mount that is configured co-axially with one or more sensors of a sighting device attached to the weapon station. In certain embodiments, weapons may be orientated at numerous elevational angles without interfering with the field-of-regard of the sensors of a sighting device.

In certain embodiments, driving rotational movement of one or more weapons and a sighting device using separate drive mechanisms may allow for the shock impulse of firing one or more of the weapons to be attenuated, which may reduce or eliminate the impact of the shock on the sighting device. This may substantially prevent (or at least reduce) the effects of the shock from being seen on a display associated with viewing output of the sighting device.

Certain embodiments of the present disclosure may provide some, all, or none of these advantages. Certain embodiments may provide one or more other technical advantages, one or more of which may be readily apparent to those skilled in the art from the figures, descriptions, and claims included herein.

BRIEF DESCRIPTION OF THE DRAWINGS

To provide a more complete understanding of embodiments of the present disclosure and the features and advantages thereof, reference is made to the following description taken in conjunction with the accompanying drawings, in which.

DESCRIPTION OF EXAMPLE EMBODIMENTS

Figure 1:
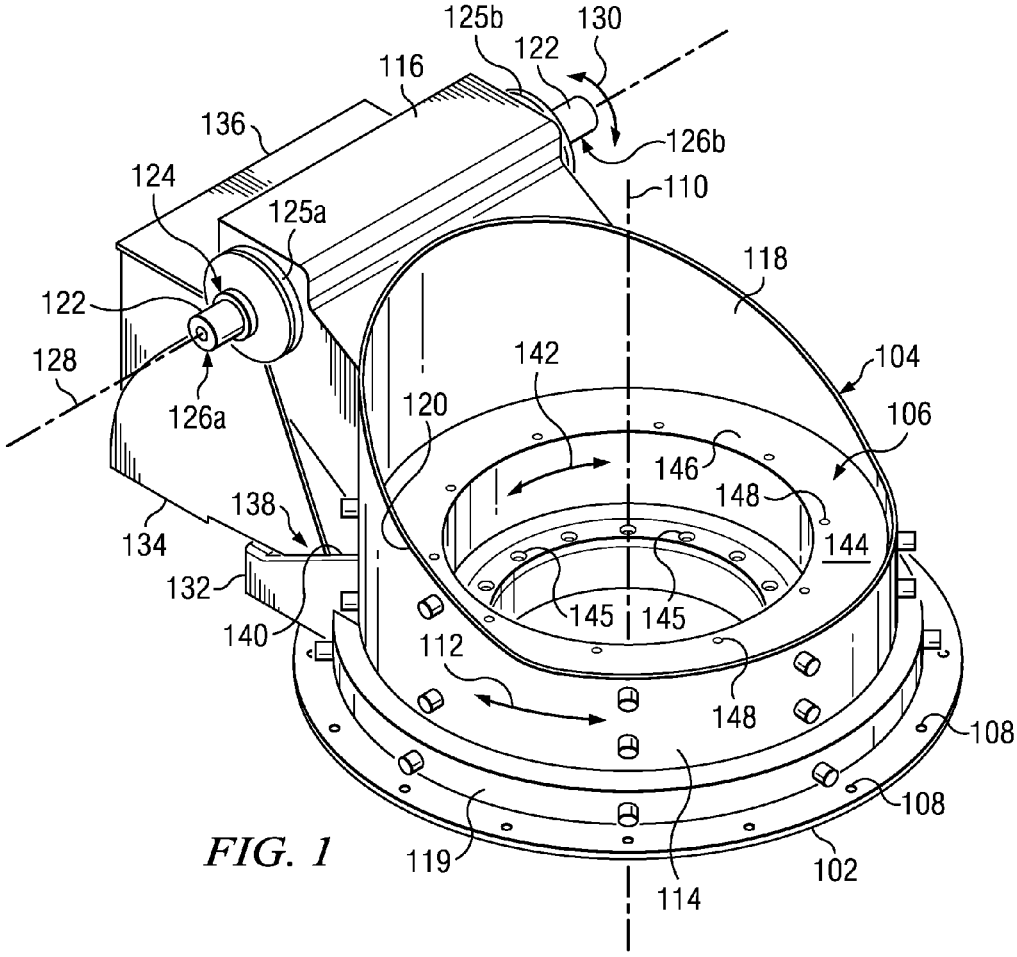
FIG. 1 illustrates an example weapon station, according to certain embodiments of the present disclosure.

FIG. 1 illustrates an example weapon station 100, according to certain embodiments of the present disclosure. Weapon station 100 may be mounted to an entity such as a vehicle, a fixed structure, or any other suitable type of entity. In the illustrated example, weapon station 100 includes a base 102, a weapon mounting apparatus 104, and a sight mounting apparatus 106. Although weapon station 100 is illustrated as including particular components in a particular configuration, these components and that configuration are provided for example purposes only.

In certain embodiments, weapon mounting apparatus 104 and at least a portion of (including, potentially, one or more sensors) a sighting device attached to sight mounting apparatus 106 are adapted to rotate about a common azimuth axis independently of one another, thereby allowing the rotational orientation of one or more weapons attached to weapon station 100 (via weapon mounting apparatus 104) and the rotational orientation of one or more sensors of sighting device attached to weapon station 100 (via sight mounting apparatus 106) to be adjusted independently of one another. Additionally or alternatively, certain embodiments may be adapted to rotate one or more weapons attached to weapon station 100 to rotate about an elevation axis independent of rotation of one or more sensors of a sighting device attached to sight mounting apparatus 106 about a different elevation axis, thereby allowing the elevational orientation of one or more weapons attached to weapon station 100 (via weapon mounting apparatus 104) and the elevational orientation of one or more sensors of a sighting device attached to weapon station 100 (via sight mounting apparatus 106) to be adjusted independently of one another. In certain embodiments, weapon mounting apparatus 104 may be configured such that one or more weapons attached to weapon mounting apparatus 104 may be offset from the common azimuth axis, which may reduce or eliminate interference of the line of sight of one or more sensors of a sighting device attached to sight mounting apparatus 106 by the one or more weapons that may otherwise be present with certain conventional weapon stations at certain rotational orientations.

Weapon station 100 may include a base 102 for coupling weapon station 100 to an entity. For example, base 102 may be coupled to the entity using one or more screws (or any other suitable type of fasteners) inserted in corresponding openings 108 of base 102. Although a particular number of openings 108 are illustrated, the present disclosure contemplates base 102 including any suitable number of openings 108 for engaging fasteners. Furthermore, although openings 108 and fasteners are described, the present disclosure contemplates base 102 being coupled to the entity using any suitable type of mechanism, according to particular needs. Although base 102 is illustrated as having a particular construction and shape, the present disclosure contemplates base 102 having any suitable construction and shape.

The entity to which weapon station 100 is coupled (e.g., using base 102) may include any suitable movable or immovable entity. For example, the entity may include a vehicle, a particular example of which is described below with respect to FIG. 12. In certain embodiments, the vehicle may include any suitable type of land, air, or sea vehicle. As another example, the entity may include a fixed structure such as a building, a post, or any other suitable type of entity.

Weapon station 100 may include a weapon mounting apparatus 104 adapted to receive for attachment to weapon station 100 one or more weapons, examples of which are described below. Weapon mounting apparatus 104 may be adapted to rotate about an azimuth axis 110, thereby rotating the attached one or more weapons about azimuth axis 110. Weapon mounting apparatus 104 may be coupled to base 102 in any suitable manner. Weapon mounting apparatus 104 also may be referred to as a sleeve.

An azimuth axis such as azimuth axis 110 may be an axis about which an object may be rotated to change the azimuth orientation of the object. For example, with respect to weapon mounting apparatus 104, azimuth axis 110 may be an axis about which weapon mounting apparatus 104 may be rotated to change the azimuth orientation of weapon mounting apparatus 104 to thereby change the azimuth orientation of one or more weapons attached to weapon mounting apparatus 104. For example, weapon mounting apparatus 104 may be rotated about azimuth axis 110 along the path shown by arrows 112.

Weapon mounting apparatus 104 may include a body portion 114 and an elevation shaft housing 116. Body portion 114 may provide the basic frame for weapon mounting apparatus 104 and may be rotatable about azimuth axis 110. In certain embodiments, the walls of body portion 114 are non-uniform. For example, in the illustrated embodiment of body portion 114 includes an elongated portion 118. In the illustrated example, body portion 114 includes a ridged portion 119, which may form an underlying channel for housing a bearing assembly (described below with reference to FIG. 4A), which may facilitate rotation of body portion 114 (and thereby weapon mounting apparatus 104). In the illustrated example, body portion 114 of weapon mounting apparatus 104 is illustrated as being generally cylindrical in shape. Although body portion 114 is illustrated and described primarily as being cylindrical in shape, the present disclosure contemplates portions of weapon mounting apparatus 104 having any suitable shape, according to particular needs. For example, body portion 114 may be a shape other than cylindrical, if appropriate.

Elevation shaft housing 116 may provide at least a portion of the structure by which one or more weapons are attached to weapon station 100. Elevation shaft housing 116 may extend outwardly from an outer surface 120 of body portion 114 of weapon mounting apparatus 104. For example, at least a portion of elevation shaft housing 116 may extend outwardly from an outer surface 120 of elongated portion 118 of body portion 114 of weapon mounting apparatus 104.

In certain embodiments, a shaft 122 may extend through elevation shaft housing 116 and provide a mechanism for attaching one or more weapons to weapon station 100. For example, shaft 122 may extend through opposing openings 124 in opposing bearing assemblies 125 of elevation shaft housing 116 such that opposing ends 126 of shaft 122 extend outward from opposing sides of elevation shaft housing 116.

Shaft 122 may be adapted to rotate about an elevation axis 128 running lengthwise substantially through the center of shaft 122. For example, shaft 122 may rotate about elevation axis 128 along the path shown by arrows 130. As will be described in greater detail below, when one or more weapons are attached to shaft 122 (e.g., at ends 126), rotation of shaft 122 about elevation axis 128 may change the elevational orientation of the one or more weapons. Shaft 122 may be offset from and substantially perpendicular to azimuth axis 110 about which weapon mounting apparatus 104 rotates.

In certain embodiments, elevation shaft housing 116 may house a rotational drive mechanism for rotational movement of shaft 122. Additional details of the rotational drive mechanism, which may include shaft 122, are described in greater detail below.

In the illustrated example, weapon mounting apparatus 104 includes a tray 132, also extending from outer surface 120 of body portion 114 of weapon mounting apparatus 104. As will be described in greater detail below, tray 132 may support at least a portion of a rotational drive mechanism for driving rotational movement of weapon mounting apparatus 104 about azimuth axis 110. Some or all of the rotational drive mechanism for driving rotational movement of weapon mounting apparatus 104 about azimuth axis 110 also may be housed by elevation shaft housing 116.

A shelf 134 may be attached to weapon station 100 to support one or more ammunition boxes 136. For example, tabs 138 of shelf 134 may engage corresponding slots 140 of tray 132 to secure shelf 134 in attachment to weapon station 104.

Weapon station 100 may include a sight mounting apparatus 106 adapted to receive for attachment to weapon station 100 one or more sighting devices. As will be described in greater detail below, at least a portion of the sighting device attached to sight mounting apparatus 106 may be adapted to rotate about azimuth axis 110 (to thereby rotate one or more sensors of the sighting device about azimuth axis 110) independent of rotation of weapon mounting apparatus 104 about azimuth axis 110. For example, sight mounting apparatus 106 may be positioned such that at least a portion of a sighting device attached to sight mounting apparatus may rotate about azimuth axis 110 along the path shown by arrows 142 (though the general diameter of the path may depend on the shape and size of the sighting device attached to sight mounting apparatus 106). It should be noted that certain sighting devices may not be centered such that azimuth axis 110 would not intersect those sighting devices in the middle of those sighting devices; however, for purposes of this description rotation of a portion of those sighting devices generally about azimuth axis 110 is considered rotation about azimuth axis 110.

Thus, weapon station 100 may allow weapon mounting apparatus 104 and at least a portion of a sighting device (e.g., one or more sensors of the sighting device) to be rotated about a common azimuth axis 110 independently of one another. As can be seen, weapon station 100 may allow one or more weapons mounted to weapon mounting apparatus 104 and at least a portion of a sighting device mounted to sight mounting apparatus 106 to be rotated about a common azimuth axis 110 independently of one another. For example, the one or more sensors of sighting device may hold a current azimuth orientation while the one or more weapons are rotated about azimuth axis 110 (or vice versa). As another example, the one or more sensors of sighting device may rotate about azimuth axis 110 in a first direction while the one or more weapons are rotated about azimuth axis 110 in a different second direction. As another example, the one or more sensors of sighting device and the one or more weapons may rotate about azimuth axis 110 in the same direction but at different speeds and/or with different target positions. As yet another example, rotational movement of the one or more sensors and the one or more weapons may be synchronized, if appropriate.

Sight mounting apparatus 106 may include a riser 144 and a slip ring (as shown below with reference to FIG. 4A). Riser 144 may include one or more openings 145, through which one or more fasteners may be inserted to secure sight mounting apparatus 106 to another suitable component of weapon station 100 (e.g., to one or more of base 102, body portion 114, and a bearing assembly, such as the one described below with reference to FIG. 4A). For example, riser 144 may be coupled to weapon station 100 using one or more fasteners inserted in corresponding openings 145 of riser 144. Although a particular number of openings 145 are illustrated, the present disclosure contemplates riser 144 including any suitable number of openings 145 for engaging fasteners. Furthermore, although openings 145 and fasteners are described, the present disclosure contemplates riser 144 being coupled to weapon station 100 using any suitable type of mechanism, according to particular needs.

Riser 144 may include a shelf 146, which may provide an engagement point for a sighting device to be attached to weapon station 100. For example, a sighting device may be coupled to riser 144 using one or more fasteners inserted in corresponding openings 148 of shelf 146. Although a particular number of openings 148 are illustrated, the present disclosure contemplates shelf 146 including any suitable number of openings 148 for engaging fasteners. Furthermore, although openings 148 and fasteners are described, the present disclosure contemplates a sighting device being coupled to sight mounting apparatus 106 using any suitable type of mechanism, according to particular needs.

Sight mounting apparatus 106 may be seated within a cavity of weapon mounting apparatus 104, and particularly within a cavity of body portion 114 of weapon mounting apparatus 104. In certain embodiments, when weapon mounting apparatus 104 rotates about azimuth axis 110, weapon mounting apparatus 104 moves along an outer perimeter of sight mounting apparatus 106. Additionally or alternatively, in certain embodiments, when at least a portion of a sighting device attached to sight mounting apparatus 106 rotates about azimuth axis 110 (independent of the rotation of weapon mounting apparatus 104), the portion of the sighting device may move generally within an interior perimeter of body portion 114, which depending at least in part on the width of shaft 122 may reduce or eliminate the likelihood that the attached sighting device and the one or more attached weapons make physical contact.

Figure 2:
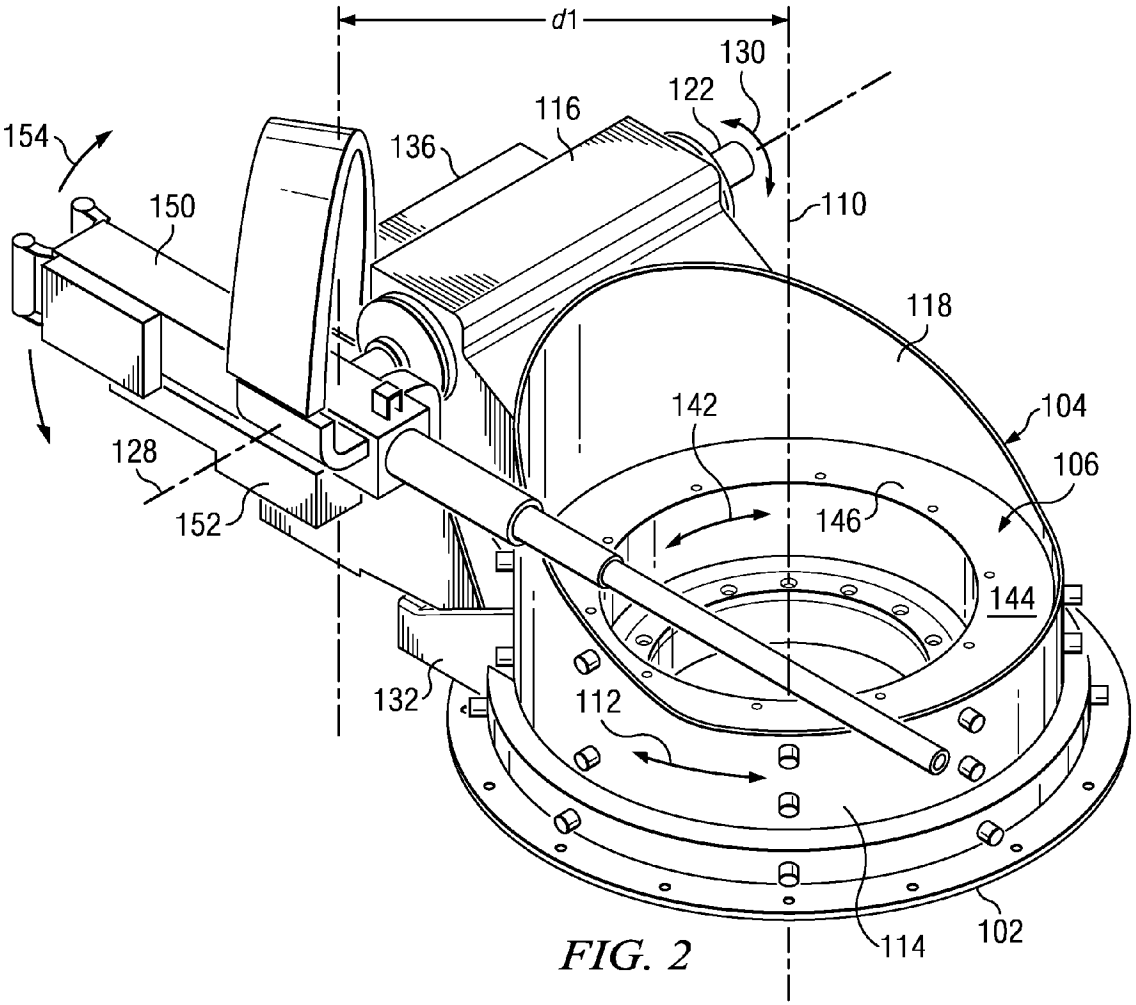
FIG. 2 illustrates the example weapon station of FIG. 1 with a weapon mounted to the weapon station, according to certain embodiments of the present disclosure.

FIG. 2 illustrates the example weapon station 100 of FIG. 1 with a weapon 150 mounted to weapon station 100, according to certain embodiments of the present disclosure. In the illustrated example, weapon 150 is mounted to weapon mounting apparatus 104 via shaft 122. For example, a weapon mount 152 is attached to an end 126*a* (as shown in FIG. 1) of shaft 122. Weapon mount 152 may be capable of mounting one or more weapons 150. Although a particular type of weapon mount 152 is illustrated, the present disclosure contemplates any suitable type of weapon mount 152 being used to attach one or more weapons 150 to weapon station 100. Furthermore, although use of a weapon mount 152 is illustrated and described, weapon 150 may be mounted to shaft 122 in any suitable manner, according to particular needs.

In the illustrated example, a single weapon 150 is mounted to weapon station 100. However, the present disclosure contemplates any suitable number and types of weapons 150 being mounted to weapon station 100. For example, a first weapon mount 152 may be attached to a first end 126*a* of shaft 122 and a second mount 152 may be attached to a second end 126*b* of shaft 122. Each weapon mount 152 may be capable of mounting one or more weapons 150 to weapon station 100.

Weapon mount 152 may be attached to an end 126 of shaft 122 in any suitable manner. A weapon mount (e.g., weapon mount 152) may be secured to an end 126 (e.g., end 126*a*) of shaft 122 such that rotation of shaft 122 about elevation axis 128 also rotates weapon mount 152, thereby changing the elevational orientation of a weapon 150 mounted by weapon mount 152. For example, rotation of shaft 122 may alter the elevational orientation of weapon 150 along the path shown by arrows 154.

Weapon 150 may be rotated about azimuth axis 110 by rotation of weapon mounting apparatus 104 about azimuth axis 110, which may change the azimuth orientation of weapon 150. Weapon 150 may be offset a distance d1 from azimuth axis 110, which, as will be described in greater detail below, may reduce or eliminate interference of weapon 150 with one or more sensors of a sighting device attached to sight mounting apparatus 106.

In the illustrated example, weapon 150 is a machine gun. Although a particular type of weapon 150 is illustrated, the present disclosure contemplates any suitable combination of weapons 150 being mounted to weapon station 100, and weapons 150 may be lethal or nonlethal. Example weapons 150 may include any suitable combination of one or more machine gun weapons 150 (e.g., an M2, M1919, M240, M249, MK19, or MR134d machine gun or any other suitable type of machine gun weapon 150), one or more missile weapons 150 (e.g., a Javelin, TOW, Hellfire, or Stinger missile weapon or any other suitable type of missile weapon 150), one or more dazzlers, one or more bright lights that emits blinding light, one or more acoustic hailers that generate disorienting audible noise, one or more radio frequency (RF) Tinglers, or any other suitable type of weapon 150. Although particular weapons 150 are described, these weapons 150 are provided for example purposes only.

Furthermore, although configurations with one or two weapons 150 mounted to weapon station 100 are primarily described, the present disclosure contemplates weapon station 100 being configured with any suitable number of weapons 150. For example, a single machine gun weapon 150 (e.g., an M2 machine gun) may be mounted to one end 126*a* of shaft 122, while two TOW missile weapons 150 disposed over two Javelin missile weapons 150 may be mounted to the opposite end 126*b* of shaft 122. As another example, weapon station 100 may be configured with two M2 machine guns weapons 150, one being mounted to each end 126 of shaft 122. As another example, weapon station 100 may be configured with two M1919 machine gun weapons 150, one being mounted to each end 126 of shaft 122. As another example weapon station 100 may be configured with two Javelin missile weapons 150, one being mounted to each end 126 of shaft 122. As another example, weapon station 100 may be configured with two M240 machine gun weapons 150, one being mounted to each end 126 of shaft 122. As another example, an MK19 machine gun weapon 150 may be mounted to one end 126*a* of shaft 122, while an M2 machine gun weapon 150 may be mounted to the opposite end 126*b* of shaft 122. As another example, weapon station 100 may be configured with two TOW missile weapons 150, one being mounted to each end 126 of shaft 122.

Figure 3:
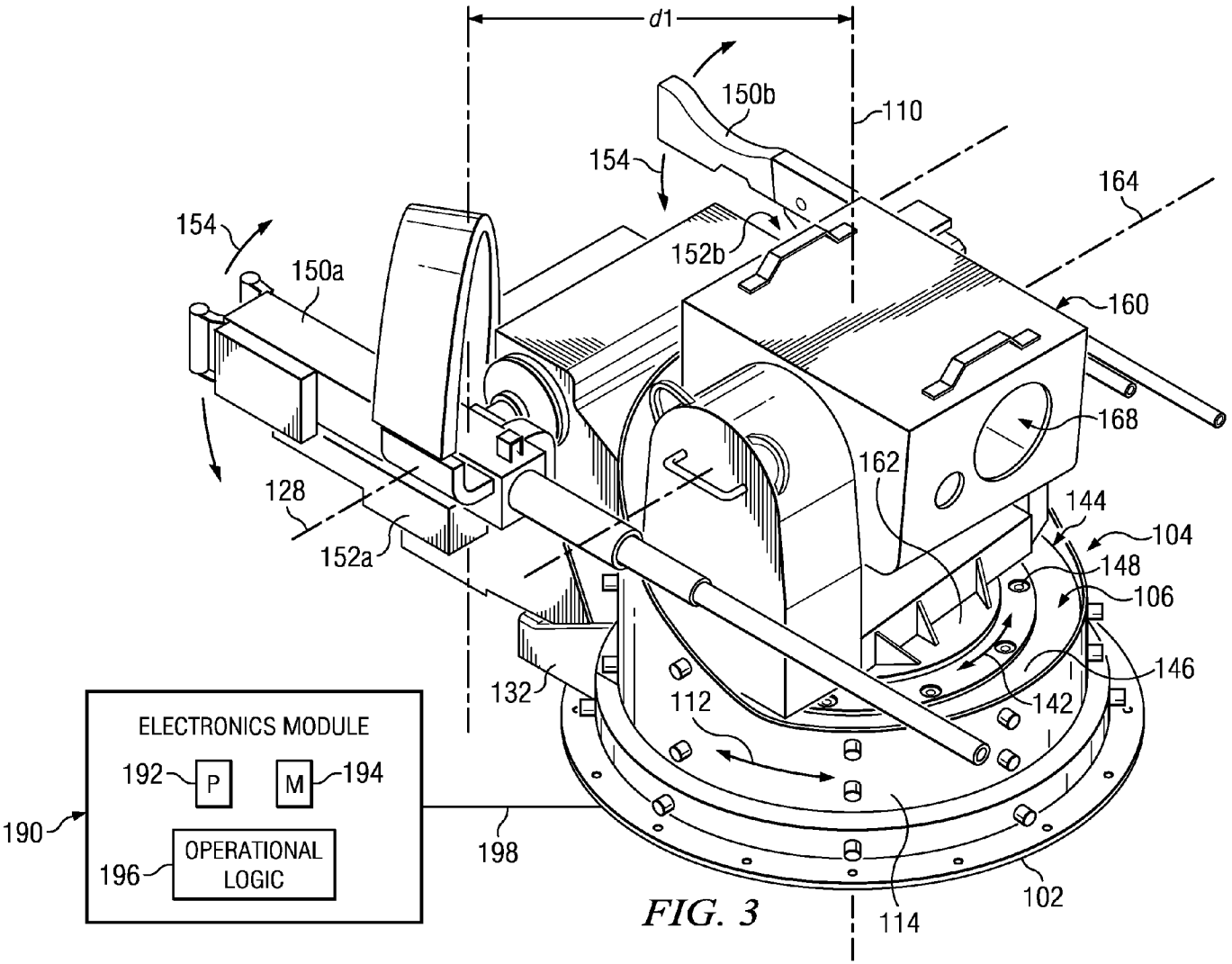
FIG. 3 illustrates the example weapon station of FIG. 1 with two weapons and a sighting device mounted to the weapon station, according to certain embodiments of the present disclosure.

FIG. 3 illustrates the example weapon station 100 of FIG. 1 with two weapons 150 and a sighting device 160 mounted to weapon station 100, according to certain embodiments of the present disclosure. In the illustrated example, a first weapon 150*a* is attached to a first end 126*a* (as shown in FIG. 1) of shaft 122 using a first weapon mount 152*a*, and a second weapon 150*b* is attached to a second end 126*b* (as shown in FIG. 1) of shaft 122 using a second mount 152*b* (which is mostly obstructed from view in FIG. 3).

In certain embodiments, sighting device 160 is attached to weapon station 100 at sight mounting apparatus 106. For example, to attach to weapon station 100, sighting device 160 may attach to a shelf 146 of riser 144 of sight mounting apparatus 106. As a particular example, sighting device 160 may be coupled to riser 144 using one or more fasteners inserted in corresponding openings 148 of shelf 146. Although a particular number of openings 148 are illustrated, the present disclosure contemplates shelf 146 including any suitable number of openings 148 for engaging fasteners. Furthermore, although openings 148 and fasteners are described, the present disclosure contemplates sighting device 160 being coupled to sight mounting apparatus 106 using any suitable type of mechanism, according to particular needs.

The azimuth orientation of weapons 150*a* and 150*b* may be changed through the rotation of weapon mounting apparatus 104 about azimuth axis 110, which also rotates weapons 150*a* and 150*b* about azimuth axis 110. The azimuth orientation of the one or more sensors of sighting device 160 may be changed through the rotation of at least a portion of sighting device 160 about azimuth axis 110. As described above, weapon mounting apparatus 104 and the one or more sensors of sighting device 160 may rotated about a common azimuth axis 110 independently of one another to thereby change the azimuth orientation of weapons 150*a* and 150*b* independently of changing the azimuth orientation of the one or more sensors of sighting device 160.

In certain embodiments, independent rotation of weapon mounting apparatus 104 and the one or sensors of sighting device 160 about common azimuth axis 110 may be driven by separate rotational drive mechanisms. For example, the rotational drive mechanism used to rotate weapon mounting apparatus 104 about azimuth axis 110 may be housed substantially by one or more of elevation shaft housing 116 and tray 132. As another example, the rotational drive mechanism used to rotate the one or more sensors of sighting device 160 about azimuth axis 110 may be housed substantially by sighting device 160. As a particular example, a base 162 of sighting device 160 may house an azimuth rotational drive mechanism for rotating at least a portion of sighting device 160 about azimuth axis 110 to thereby rotate the one or more sensors of sighting device 160 about azimuth axis 110. In certain embodiments, driving rotational movement of weapons 150 and sighting device 160 using separate drive mechanisms may allow for the shock impulse of firing one or more of the weapons 150 to be attenuated, which may reduce or eliminate the impact of the shock on the sighting device 160. This may substantially prevent (or at least reduce) the effects of the shock from being seen on a display associated with viewing output of sighting device 160.

The elevational orientation of weapons 150*a* and 150*b* may be changed through the rotation of shaft 122 (to which weapons 150*a* and 150*b* are attached) about elevation axis 128, which also rotates weapons 150*a* and 150*b* about elevation axis 128. As described above, rotation of weapons 150*a* and 150*b* about elevation axis 128 may be driven by a rotational drive mechanism that is housed in elevation shaft housing 116.

The elevational orientation of the one or more sensors of sighting device 160 may be changed through the rotation of at least a portion of sighting device 160 about an elevation axis 164, which may be a different elevation axis than elevation axis 128 (about which weapons 150*a* and 150*b* rotate). Rotation of the one or more sensors of sighting device 160 about elevation axis 164 may be driven by a rotational drive mechanism that is housed in sighting device 160, which may be separate from the rotational drive mechanism that drives weapons 150*a* and 150*b* to rotate about elevation axis 128. For example, the rotational drive mechanism that drives rotation of the one or more sensors of sighting device 160 about elevation axis 164 may be housed in base 162 of sighting device 160. In certain embodiments, the elevational orientation of weapons 150*a* and 150*b* and of the one or more sensors of sighting device 160 may be changed independently of one another about separate elevational axes (128 and 164, respectively).

As described above, in certain embodiments, weapons 150*a* and 150*b* may be offset a distance d1 from azimuth axis 110, which may reduce or eliminate interference of weapon 150 with one or more sensors of a sighting device attached to sight mounting apparatus 106. For example, the offset position of the weapons 150*a* and 150*b* may reduce or eliminate obstruction of the line-of-sight of the one or more sensors of the sighting device 160 by the attached weapons 150. As another example, the offset position of the one or more attached weapons 150 may provide a relatively smaller footprint or keep-out-zone to the weapon station 100 than would otherwise be provided by a weapon mount that is configured co-axially with one or more sensors of a sighting device attached to a weapon station.

Although a particular type of sighting device 160 is illustrated, the present disclosure contemplates weapon station 100 being configured with any suitable type of sighting device 160. Example sighting devices 160 may include an EOTECH sight, a Commander's Independent Thermal Viewer (CITV) sight, a Medium Range Electro-Optic Sensor for an Unmanned Ground Vehicle (MREO-UGV), or any other suitable type of sighting device 160. Although particular sighting devices 160 are described, these sighting devices 160 are provided for example purposes only.

Sighting device 160 may include one or more sensors (obstructed from view in cavity 168 of sighting device 160) operable to gather visual imagery or other information around the entity to which weapon station 100 is mounted. Sighting device 160 may include any suitable types of sensors in any suitable combination. For example, one or more sensors may be coupled to an image processor that detects certain objects via their shape and/or movement and instructs the rotational drive mechanisms to automatically move weapon(s) 150 to intercept these objects. As another example, one or more sensors may generate imagery that may be viewed on a display of a computer system. Particular example sensors may include an unmanned ground vehicle (UGV) sighting sensor, a camera (e.g., a video camera, an infrared night vision camera, or any other suitable type of camera), a radar, a global positioning system (GPS) or other sensory device that determines the location of the entity on which weapon station 100 is mounted, and any other suitable type of sensor. Although particular sensors are described, these sensors are provided for example purposes only.

In certain embodiments, an electronics module 190 may be included in or otherwise operable to communicated with portions suitable portions of weapon station 100. Electronics module 190 may be implemented using any suitable combination of hardware, firmware, and software. Electronics module 190 may include one or more computer systems at one or more locations. Each computer system may include any appropriate input devices, output devices, mass storage media, processors, memory, or other suitable components for receiving, processing, storing, and communicating data. For example, each computer system may include an integrated circuit (IC), printed circuit board (PCB), personal computer, workstation, network computer, kiosk, wireless data port, personal data assistant (PDA), one or more Internet Protocol (IP) telephones, one or more cellular/smart phones, one or more servers, a server pool, a network gateway, a router, a switch, one or more processors within these or other devices, or any other suitable processing device. Electronics module 190 may be a stand-alone computer or may be a part of a larger network of computers associated with an entity.

Electronics module 190 may include one or more processing units 192 and one or more memory units 194, referred to hereinafter in the singular for simplicity. Each processing unit 192 may include one or more microprocessors, controllers, or any other suitable computing devices or resources. Each processing unit 192 may work, either alone or with other components of weapon station 100, to provide a portion or all of the functionality of its associated computer system described herein. Each memory unit 194 may take the form of a suitable combination of volatile and non-volatile memory including, without limitation, magnetic media, optical media, read-access memory (RAM), read-only memory (ROM), removable media, or any other suitable memory component.

Electronics module 190 may include operational logic 196. Operational logic 196 may be implemented in any suitable combination of hardware, firmware, and software. In certain embodiments, logic 196 comprises a set of computer-readable instructions (stored in memory module 194 or some other suitable computer-readable storage medium) that when executed by processing units 194 are operable to perform certain operations.

Logic 196 may analyze certain information and communicate various instructions to and/or within weapon station 100. For example, logic 196 may be operable to determine position information for positioning one or more of weapons 150 and sighting device 160 and to communicate instructions to weapon station 100 to cause appropriate components of weapon station 100 to adjust position, if appropriate, to effect the determined position. In certain embodiments, logic 196 may receive information from sighting device 160 (e.g., about the location of one or more targets) and incorporate that received information into the determined position information. Additionally or alternatively, logic 196 may receive position information from a user of electronics module 190 or from any other suitable source. For example, logic 196 may receive and/or determine position information based on information received from sources other than sighting device 160, such as one or more other sighting devices (in addition to or as an alternative to receiving information from sighting device 160).

Electronics module 190 may communicate with one or more components of weapon station 100 using one or more links 198. Links 198 facilitate wireless or wireline communication. Links 198 may include one or more one or more computer buses, local area networks (LANs), radio access networks (RANs), metropolitan area networks (MANs), wide area networks (WANs), mobile networks (e.g., using WiMax (802.16), WiFi (802.11), 3G, 4G, or any other suitable wireless technologies in any suitable combination), all or a portion of the global computer network known as the Internet, and/or any other communication system or systems at one or more locations, any of which may be any suitable combination of wireless and wireline.

One example electronic module 190 includes a global positioning system (GPS)/inertial navigation system (INS) commonly referred to as an 'eTalin' device. The eTalin device is approximately 10.9 by 7.6 by 6.0 inches in size and weighs approximately 13.5 pounds. Another example, electronic module 190 includes a CEEU advanced signal processing electronics unit that is approximately 12.8 by 14.2 by 7.9 inches in size and weighs approximately 67 pounds. Another example electronic module 190 includes PSC device that is approximately 12.8 by 6.4 by 7.9 inches in size and weighs approximately 34 pounds.

Electronics module 192 may be located in any suitable physical location, according to particular needs. For example, electronics module 192 may be stored internal to weapon station 100. As just one particular example, body portion 114 of weapon mounting apparatus 104 may be sized suitably to house electronics module 192. As another example, electronics module 192 may be stored external to weapon station 100. As particular examples, electronics module 192 may be stored in the entity (e.g., a vehicle or fixed structure) to which weapon station 100 is attached, at a structure remote from the location of weapon station 100, or at any other suitable location.

Figure 4A:
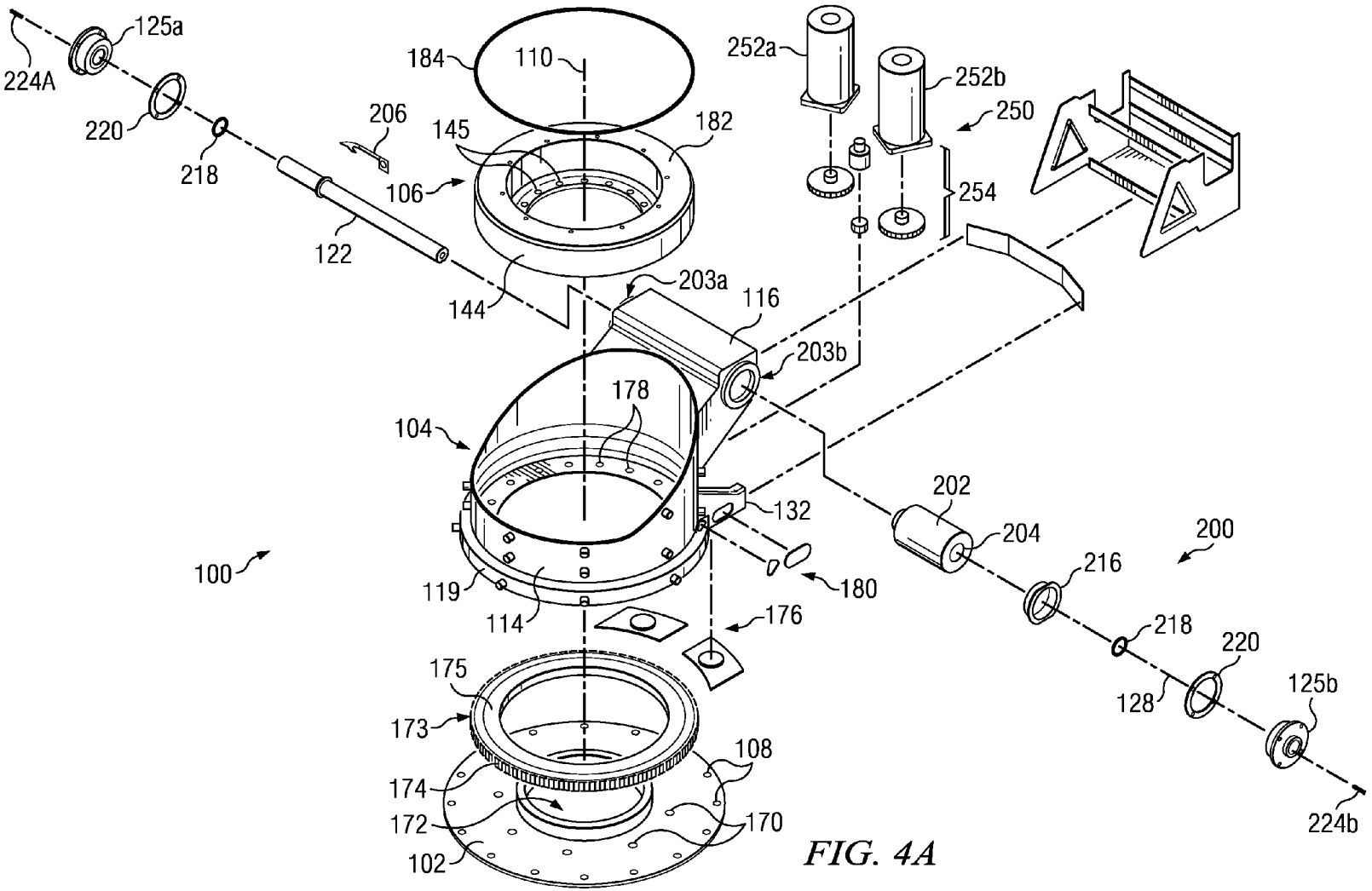
FIGS. 4A-4C illustrate an exploded view of various example components of the weapon station of FIG. 1, according to certain embodiments of the present disclosure.
Figure 4B:
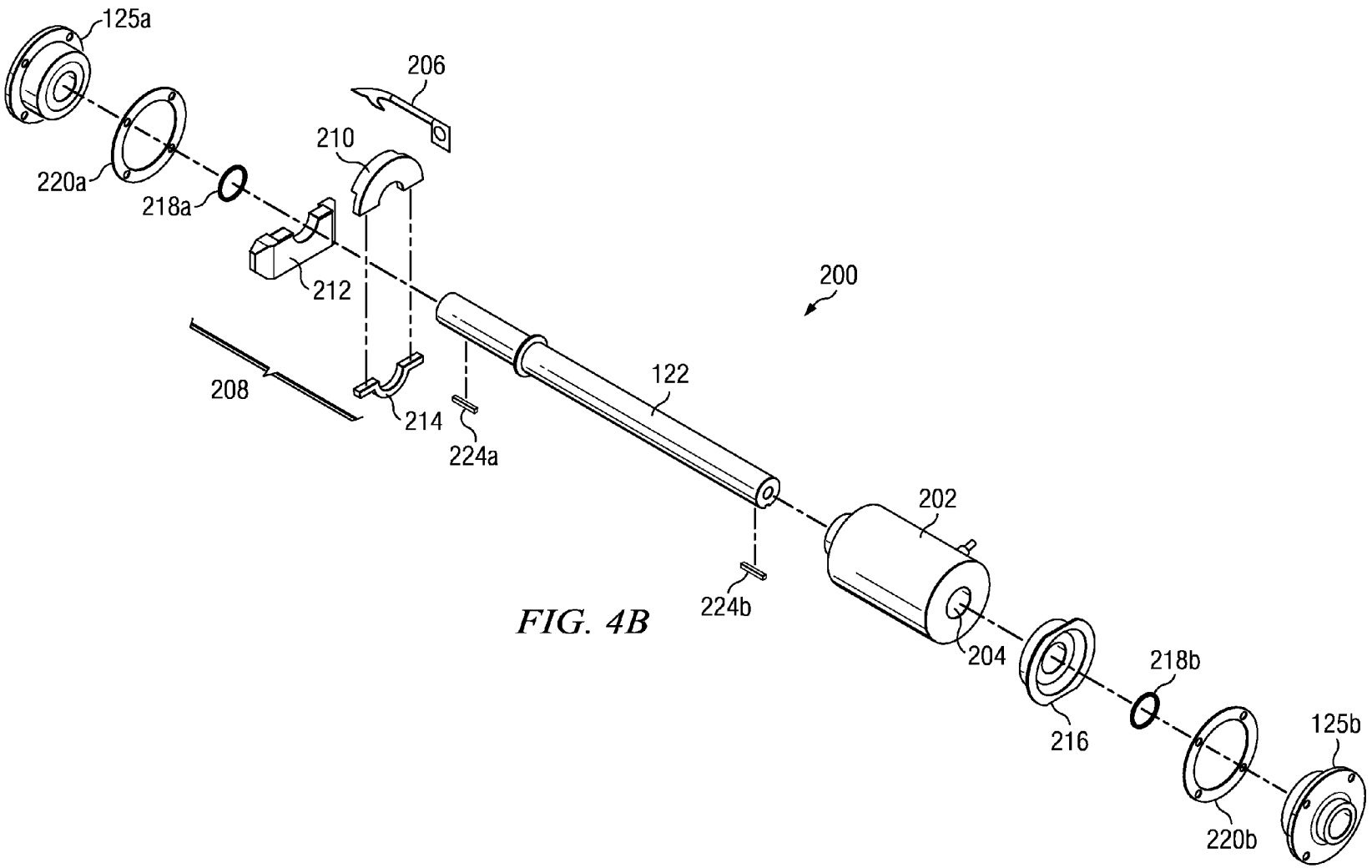
Figure 4C:
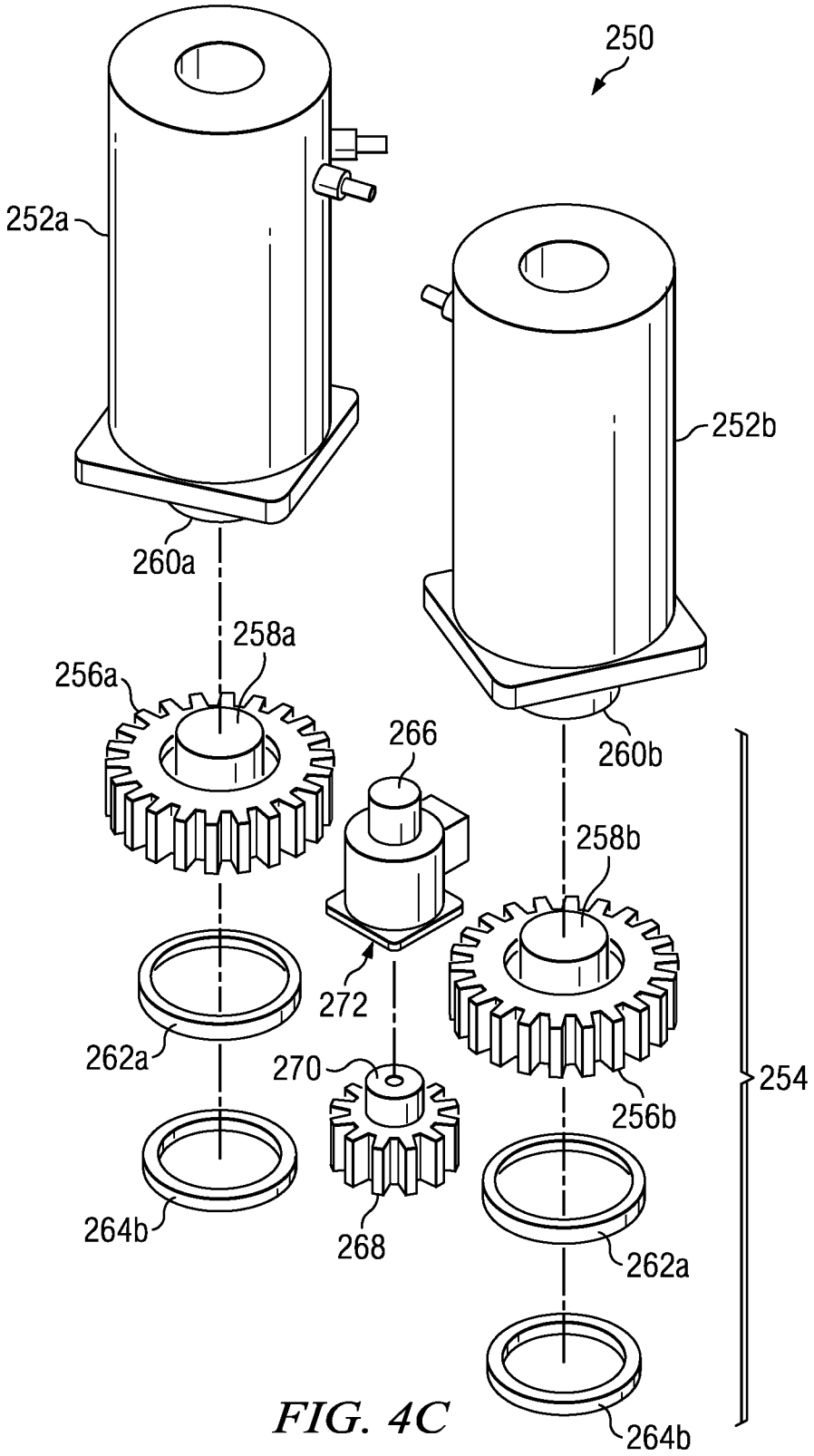

FIGS. 4A-4C illustrate an exploded view of various example components of weapon station 100 of FIG. 1, according to certain embodiments of the present disclosure. In particular FIG. 4A illustrates an exploded view of various components of weapon mounting apparatus 104 and sight mounting apparatus 106, including example components of both an azimuth rotational drive mechanism and an elevation rotational drive mechanism of weapon mounting apparatus 104. FIG. 4B illustrates an exploded view focusing on example components of an elevation rotational drive mechanism 200 of weapon station 100. FIG. 4C illustrates an exploded view focusing on example components of an azimuth rotational drive mechanism 250 of weapon station 100. Although weapon station 100, including weapon mounting apparatus 104, sight mounting apparatus 106, azimuth rotational drive mechanism 250, and the elevation rotational drive mechanism 200, are illustrated and described as including particular components in a particular configuration, this is provided for example purposes only.

Turning to FIG. 4A, base 102 may comprise a base plate. The base plate may openings 108, described above with reference to FIG. 1, which may facilitate the securing of base 102 (and thereby weapon station 100) to an entity. The base plate may include additional openings for securing other components of weapon station 100 to base 102. For example, base plate 102 may include openings 170 that may be used to secure riser 144 of sight mounting apparatus 106 to base 102. Base 102 may include an aperture 172, which in certain embodiments may be used to pass electrical wiring or other components to other elements of weapon station 100.

A substantially ring-shaped rotational gear assembly 173 may be positioned on base 102. If appropriate, rotational gear assembly 173 may include one or more openings through which one or more fasteners may be inserted for securing bearing assembly to base 102 or another suitable component of weapon station 100. Rotational gear assembly 173 may facilitate rotational movement of weapon mounting apparatus 104 about azimuth axis 110. In certain embodiments, rotational gear assembly 173 comprises a gear 174 and a bearing assembly 175. In this particular example, both gear 174 and bearing assembly 175 are ring-shaped, with the ring-shaped gear 174 surrounding a circumference of the ring-shaped bearing assembly 175. One or more motor base plates 176 may be positioned on base 102 outside the perimeter of rotational gear assembly 173 such the motor base plates 176 will be positioned under tray 132 of weapon mounting apparatus 104 when weapon mounting apparatus is positioned on base 102.

Weapon mounting apparatus 104 may be positioned on base 102 such that a channel underlying ridge 119 of weapon mounting apparatus 104 overlays and is at least partially filled by rotational gear assembly 173. Weapon mounting apparatus 104 may be secured to base 102 and/or rotational gear assembly 173 using one or more fasteners positioned through corresponding openings 178 of weapon mounting apparatus 104. Open areas in the base of tray 132 of weapon mounting apparatus 104 may be positioned over base plates 176. One or more covers 180 may be positioned over walls of tray 132.

Sight mounting apparatus 106 may be inserted into and seated within a cavity of weapon mounting apparatus 104, and particularly within a cavity of body portion 114 of weapon mounting apparatus 104. In certain embodiments, sight mounting apparatus 106 may include riser 144 and a slip ring 182. Fasteners may be inserted in openings 145 of riser 144 to secure sight mounting apparatus 106 to base 102 and/or weapon mounting apparatus 104. In certain embodiments, a seal 184 may surround a portion of sight mounting apparatus 106 to provide a seal between body portion 114 of weapon mounting apparatus and sight mounting apparatus 106.

In certain embodiments, openings of one or more of base 102, rotational gear assembly 173, weapon mounting assembly 104, and riser 144 may align such that a common fastener may be inserted through corresponding aligning openings to secure these components and intervening components in place. However, the present disclosure contemplates securing these components in place in any suitable manner, according to particular needs.

As shown in FIGS. 4A and 4B, weapon station 100 may include a rotational drive mechanism 200 for changing the elevational orientation of one or more weapons 150 attached to weapon station 100. A motor 202 may be inserted through opening 203 of elevation shaft housing 116 or otherwise positioned inside elevation shaft housing 116. Shaft 122 may be positioned to extend through openings 203*a* and 203*b* of elevation shaft housing 116, as well as through channel 204 of motor 202. Shaft 122 and motor 202 may be coupled together in any suitable manner such that motor 202 is operable to drive rotational movement (e.g., in the directions indicated by arrows 130 of FIG. 1) of shaft 122. In certain embodiments, a gyroscope 206 may be attached to shaft 122 to help measure and/or maintain orientation of shaft 122 during rotational movement of shaft 122. In certain embodiments, a clamp assembly 208 is used to secure shaft 122 to motor 202. In the illustrated example, clamp assembly 208 may be a stop clamp that includes a top half 210, a stop bracket 212, and a lower half 214.

A resolver assembly 216 may be coupled to at least one end of shaft 122 and may comprise a rotary electrical transformer for measuring degrees of rotation of shaft 122 (e.g., about elevation axis 128). Corresponding shaft stops 218 may be inserted over shaft 122. Appropriately-sized corresponding shims 220 also may be inserted over shaft 122 to provide a better fit for coupling components of elevation rotational drive mechanism 200.

Corresponding bearing assemblies 125 may be inserted over opposing ends of shaft 122 and slid to engage with corresponding openings 203 of elevation shaft housing 116. In certain embodiments, bearing assemblies 125 may be coupled to sides of elevation shaft housing 116 at corresponding openings 203. For example, fasteners may be inserted through corresponding openings in bearing assemblies 125 and surrounding a corresponding opening 203 of elevation shaft housing 116 to secure bearing assemblies 125 to weapon mounting apparatus 104 (e.g., at elevation shaft housing 116). Bearing assemblies 125 may facilitate rotation of shaft 122 while also stabilizing shaft 122 in openings 203 of elevation shaft housing 116. In certain embodiments, one or more keys 224 may be used to connect a suitable component (e.g., a weapon mount 152) to shaft 122 to facilitate rotation of the component.

As shown in FIGS. 4A and 4C, weapon station 100 may include a rotational drive mechanism 250 for rotating weapon mounting apparatus 104 about azimuth axis 110 to change the azimuth orientation of one or more weapons 150 attached to weapon station 100. One or more motors 252 may be used to drive the rotational movement of weapon mounting apparatus 104 about azimuth axis 110.

A gear assembly 254 may be used to facilitate rotational movement of weapon mounting apparatus 104 about azimuth axis 110 in response to operation of one or more motors 252. Gear assembly 254 may include a motor gear 256 corresponding to each motor 252. A protrusion 258 of a motor gear 256 may engage with an opening 260 in the corresponding motor 252. Operation of a motor 252 may drive rotational movement of the motor gear 256 that corresponds to the motor 252. A corresponding bearing adaptor 262 and motor bearing 264 may be coupled to each motor gear 256 to facilitate rotation of the motor gear 256. In certain embodiments, motor bearing 264 may sit over a protrusion of a corresponding base plate 176 that is exposed in open areas in the base of tray 132 of weapon mounting apparatus 104.

A resolver 266 and resolver gear 268 may be positioned substantially between motors 252 and/or motor gears 256. Resolver 266 may comprise a rotary electrical transformer for measuring degrees of rotation resulting from movement caused by motors 252. Rotation of resolver gear 268 resulting from engagement with motor gears 256 may be used by resolver 266 to determine these measurements. Teeth of motor gears 256 may engage teeth of resolver gear 268 to result in rotation of resolver gear 268. A protrusion 270 of a resolver gear 268 may engage with an opening 272 in resolver 266.

In certain embodiments, to facilitate rotational movement of weapon mounting apparatus 104, motor gears 256 may be rotated by motors 252. As motor gears 256 rotate, teeth of motor gears 256 may engage with teeth of gear 174 of rotational gear assembly 173 to facilitate rotational movement of body portion 114 of weapon mounting apparatus 104, and thereby facilitate rotational movement of weapon mounting apparatus 104 (and attached weapons 150) about azimuth axis 110. Although this particular mechanism for driving rotational movement of weapon mounting apparatus 104 (and attached weapons 150) about azimuth axis 110 is illustrated and primarily described, the present disclosure contemplates driving rotational movement of weapon mounting apparatus 104 (and attached weapons 150) about azimuth axis 110 in any suitable manner, according to particular needs.

Figure 5:
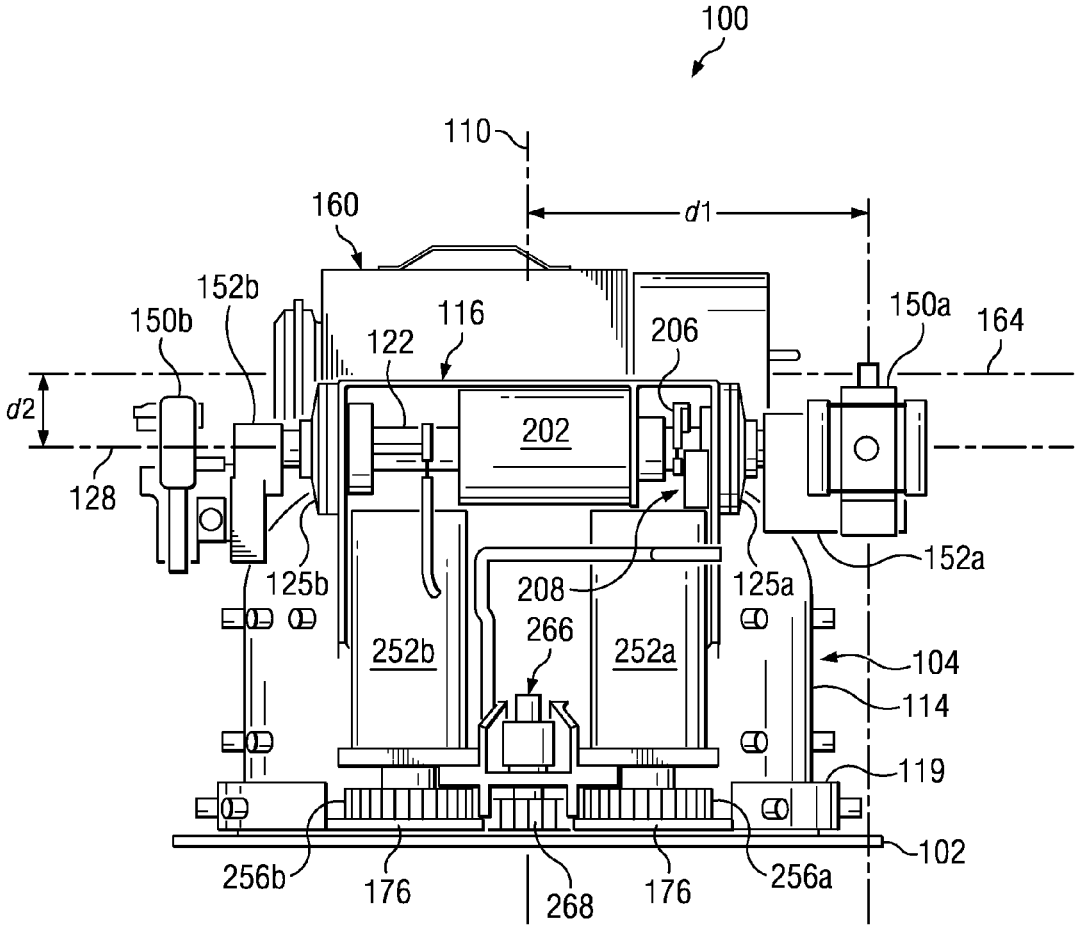
FIG. 5 illustrates a cross-sectional view of the weapon station of FIG. 1, showing the elevation rotational drive mechanism and the azimuth rotational drive mechanism of FIGS. 4A-4C assembled in the weapon station, according to certain embodiments of the present disclosure.

FIG. 5 illustrates a cross-sectional view of weapon station 100 of FIG. 1, showing elevation rotational drive mechanism 200 and azimuth rotational drive mechanism 250 of FIGS. 4A-4C assembled in weapon station 100, according to certain embodiments of the present disclosure. Although the example components of weapon station 100 described above with reference to FIGS. 4A-4C are illustrated as being assembled in a particular manner, the present disclosure contemplates assembling those and other appropriate components in any suitable manner according to particular needs.

A different view of distance d1, described above with reference to FIGS. 2 and 3, as well as an offset d2 is shown in FIG. 5. Distance d1 may described an offset between weapon(s) 150 from azimuth axis 110, which may reduce or eliminate interference of weapon 150 with one or more sensors of sighting device 160 attached to sight mounting apparatus 106. Distance d2 may describe an offset between elevation rotational axis 124 about which shaft 122 (and thereby attached weapons 150) rotate and elevation rotational axis 164 about which the one or more sensors of sighting device 160 rotate. Distance d2 may reduce or eliminate interference of weapon 150 with one or more sensors of sighting device 160 attached to sight mounting apparatus 106. For example, distance d2 may allow the one or more sensors of sighting device 160 to a relatively unobstructed view nominally over weapons 150 as sighting device 160 and/or weapons 150 rotate about azimuth axis 110.

Figure 6A:
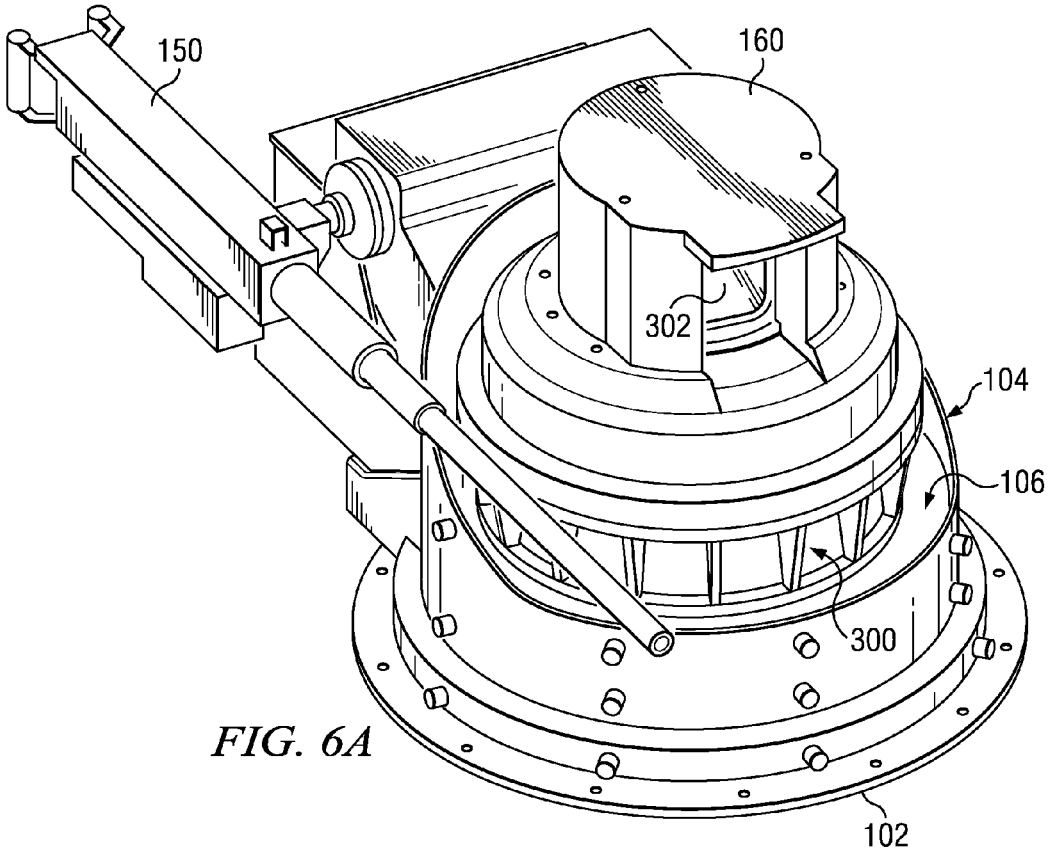
FIGS. 6A-6B illustrate top-angled and front views, respectively, of another example embodiment of the weapon station of FIG. 1 with a single weapon and an alternate sighting device mounted to the weapon station, according to certain embodiments of the present disclosure.
Figure 6B:
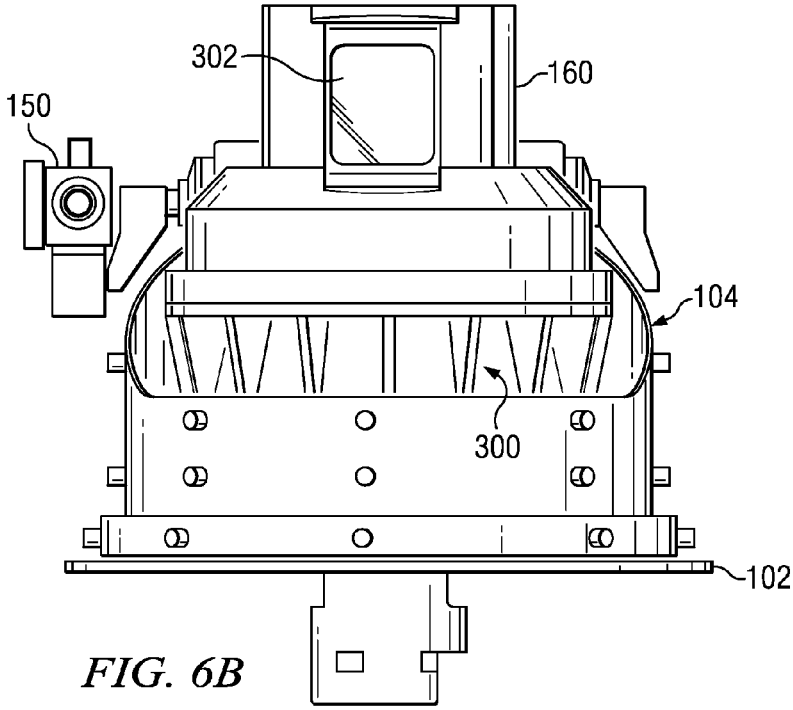

FIGS. 6A-6B illustrate top-angled and front views, respectively, of another example embodiment of weapon station 100 of FIG. 1 with a single weapon 150 and an alternate sighting device 160 mounted to weapon station 100, according to certain embodiments of the present disclosure. In this example, the sighting device 160 attached to sight mounting apparatus 106 is a Commander's Independent Thermal Viewer (CITV) sight.

In certain embodiments, sighting device 160 may be attached to sighting attachment apparatus 106 with an adapter 300, which in the illustrated example is a six-inch adapter. Use of an adapter 300 may adjust the height of sighting device 160 and thereby adjust the height of sensors 302. In certain embodiments, use of adapter 300 may be useful to reduce or eliminate interference between weapon 150 and sensors 302 of sighting device 160, depending on the size and relationship of weapon 150 and sighting device 160 in certain implementations. Attachment of sighting device 160 to sight mounting apparatus 106 with an adapter 300 is optional. Additionally, when used, adapter 300 may have any suitable size and shape, according to particular needs.

Figure 7A:
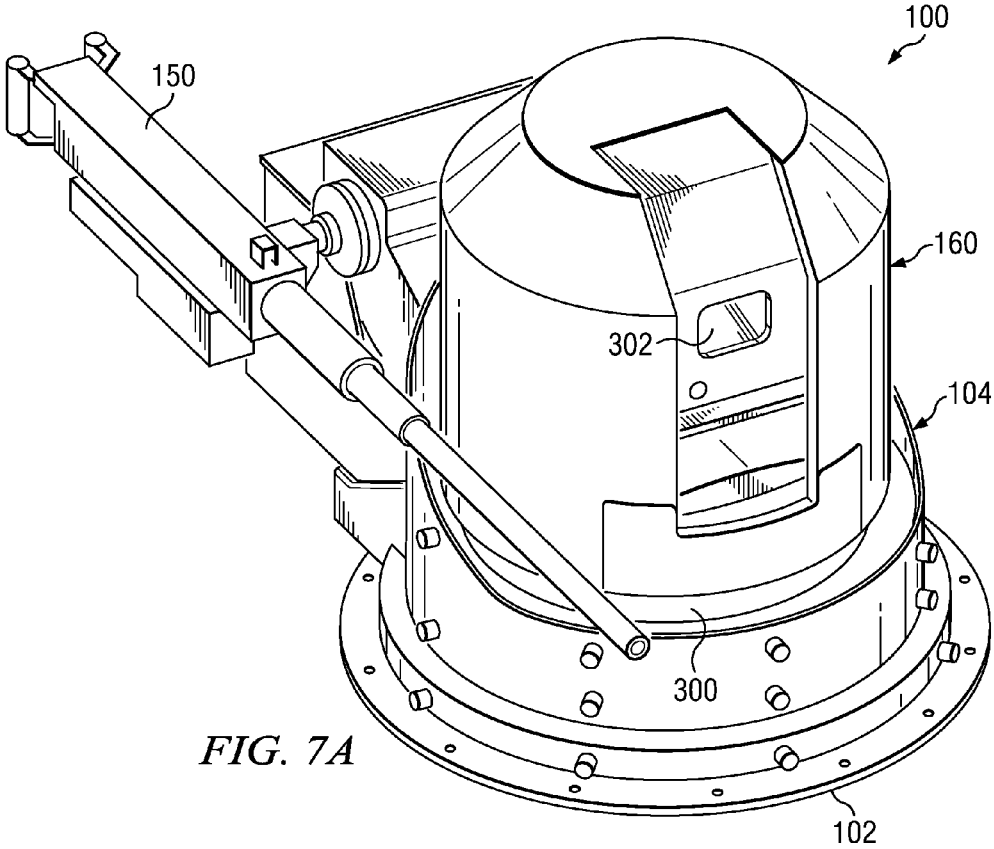
FIGS. 7A-7B illustrate top-angled and front views, respectively, of another example embodiment of the weapon station of FIG. 1 with a single weapon and an alternate sighting device mounted to the weapon station, according to certain embodiments of the present disclosure.
Figure 7B:
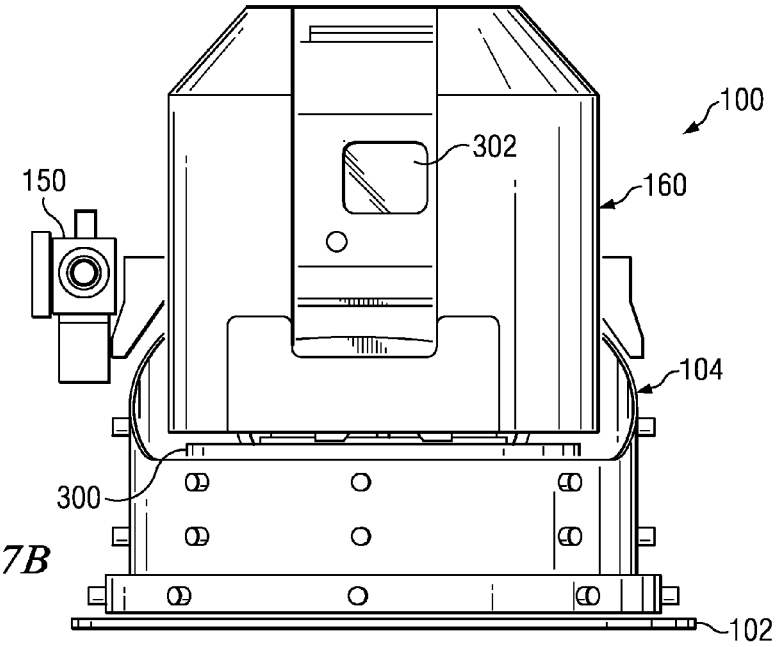

FIGS. 7A-7B illustrate top-angled and front views, respectively, of another example embodiment of weapon station 100 of FIG. 1 with a single weapon 150 and an alternate sighting device 160 mounted to weapon station 100, according to certain embodiments of the present disclosure. In this example, the sighting device 160 attached to sight mounting apparatus 106 is a Medium Range Electro-Optic Sensor for an Unmanned Ground Vehicle (MREO-UGV). Additionally, in this example, sighting device 160 is attached to sighting attachment apparatus 106 with a two-inch adapter 300.

Figure 8A:
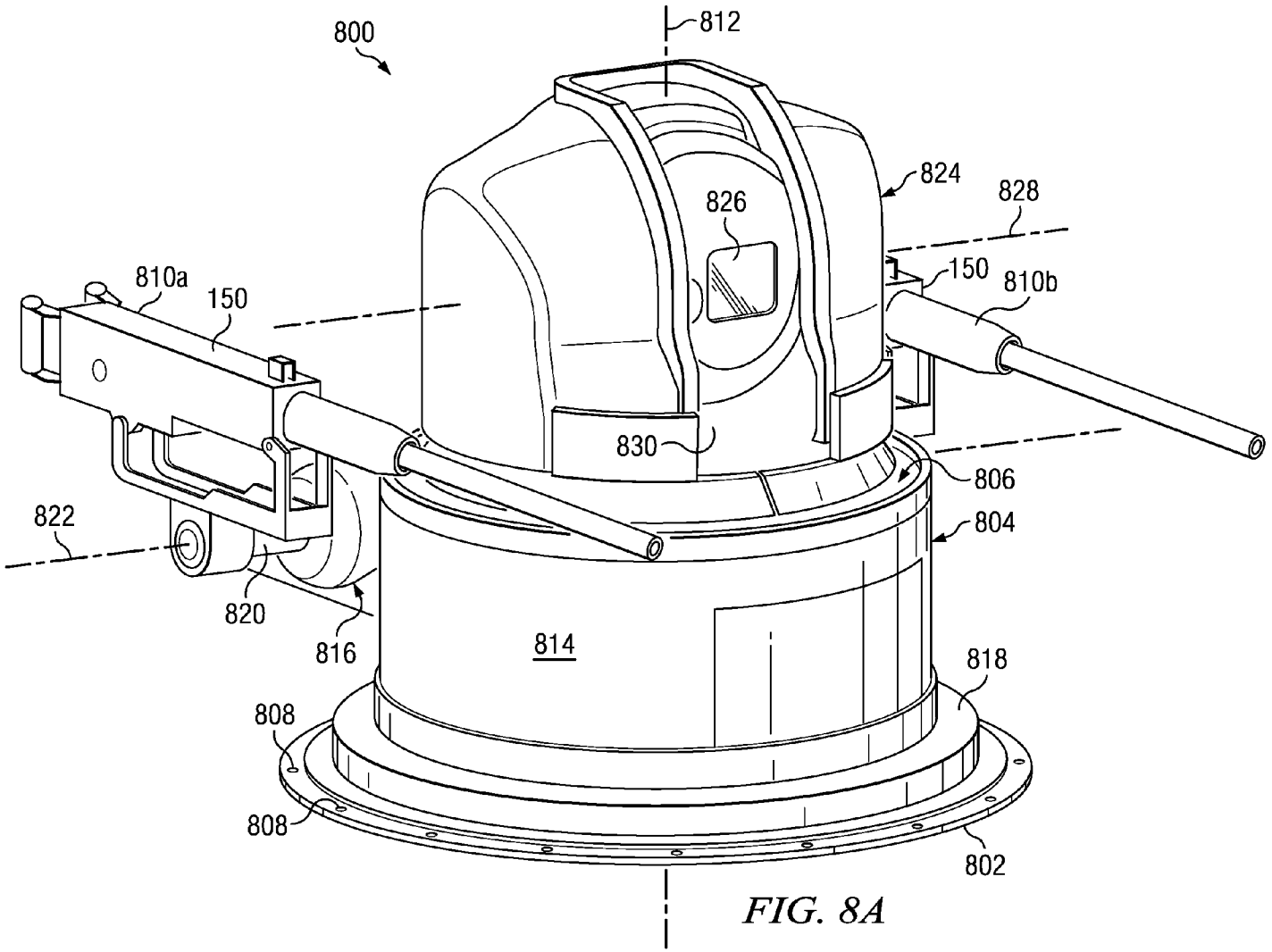
FIGS. 8A-8B illustrate top-angled and top views, respectively, of an alternative weapon station, according to certain embodiments of the present disclosure.
Figure 8B:
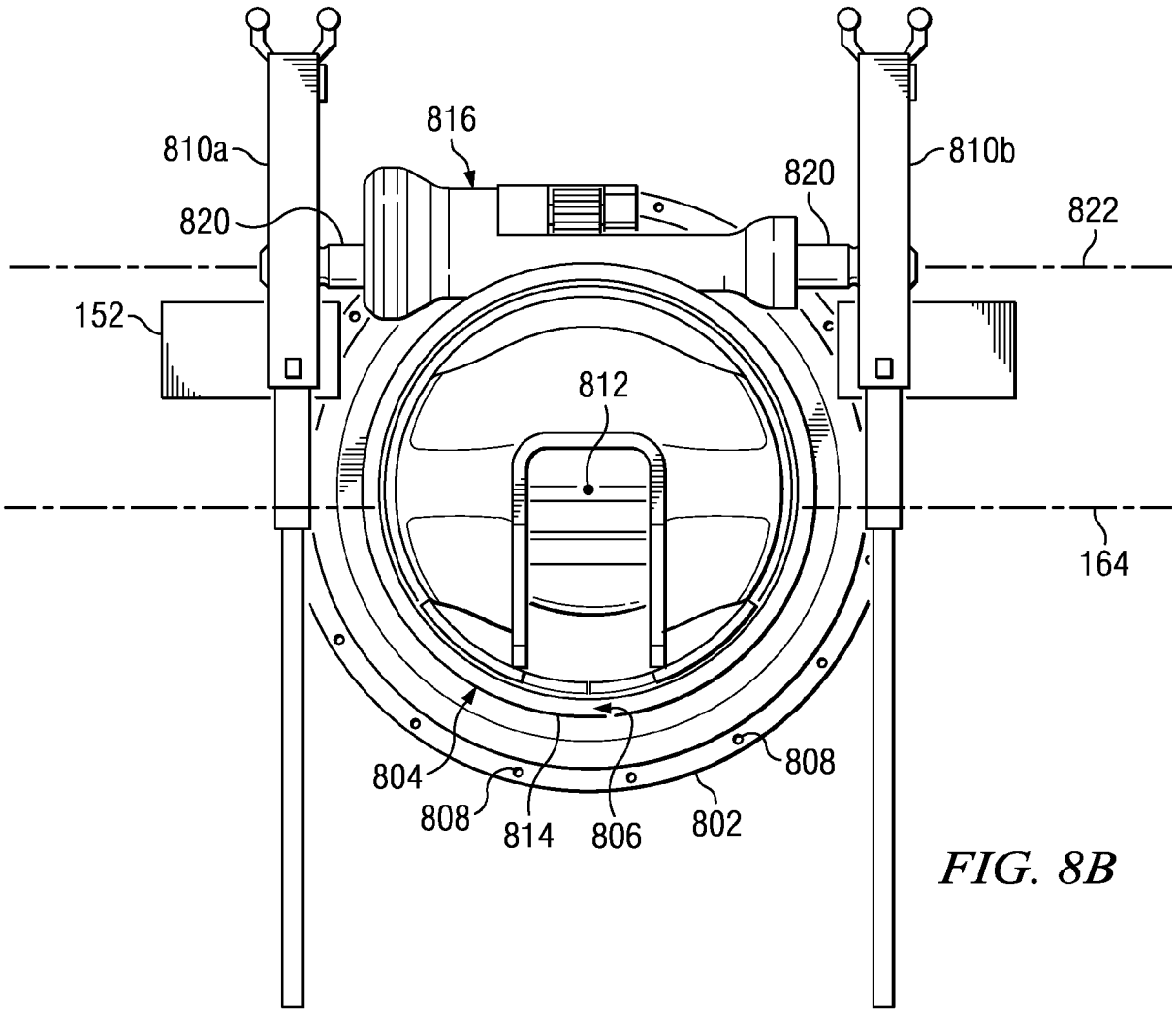

FIGS. 8A-8B illustrate top-angled and top views, respectively, of an alternative weapon station 800, according to certain embodiments of the present disclosure. Certain features of weapon station 800 that share the same name as corresponding features of weapon station 100 are substantially similar to those described above with reference to weapon station 100 and will not be described again. In the illustrated example, as will be described in greater detail below, the azimuth drive rotational mechanism for rotating one or more weapons attached to weapon station 800 is positioned under a sight mounting apparatus and a sighting device attached to sight mounting apparatus.

Weapon station 800 includes a base 802, a weapon mounting apparatus 804, and a sight mounting apparatus 806. Base 802 includes one or more openings 808 for insertion of corresponding fasteners to attach base 802 (and thereby weapon station 800) to an entity.

Weapon mounting apparatus 804 may be adapted to receive for attachment to weapon station 800 one or more weapons 810. Weapon mounting apparatus 804 may be adapted to rotate about an azimuth axis 812, thereby rotating the attached one or more weapons 810 about azimuth axis 812 to change the azimuth orientation of weapons 810. Weapon mounting apparatus 804 may be coupled to base 802 in any suitable manner. Weapon mounting apparatus 804 also may be referred to as a sleeve. Weapon mounting apparatus 804 may include a body portion 814 and an elevation shaft housing 816. Body portion 814 may provide the basic frame for weapon mounting apparatus 804 and may be rotatable about azimuth axis 812. In the illustrated example, body portion 814 includes a ridged portion 818, which may form an underlying channel for housing a bearing assembly, which may facilitate rotation of body portion 814 (and thereby weapon mounting apparatus 804).

Elevation shaft housing 816 may provide at least a portion of the structure by which one or more weapons 810 are attached to weapon station 800. Elevation shaft housing 816 may be positioned at an outer surface of body portion 814, and at least a portion of elevation shaft housing 816 may extend into a cavity of body portion 814.

In certain embodiments, a shaft 820 may extend through elevation shaft housing 816 and provide a mechanism for attaching one or more weapons 810 to weapon station 800. For example, shaft 820 may extend through opposing apertures in elevation shaft housing 816 such that opposing ends of shaft 820 extend outward from opposing sides of elevation shaft housing 816.

Shaft 820 may be adapted to rotate about an elevation axis 822 running lengthwise substantially through the center of shaft 820. For example, shaft 820 may rotate about elevation axis 822. Rotation of shaft 820 about elevation axis 822 may change the elevational orientation of the attached one or more weapons 810. Shaft 820 may be offset from and substantially perpendicular to azimuth axis 812 about which weapon mounting apparatus 804 rotates.

In certain embodiments, body portion 814 and/or elevation shaft housing 816 may house one or more rotational drive mechanisms for rotational movement of weapon mounting apparatus about azimuth axis 812 and shaft 820 about elevation axis 822.

Weapon station 800 may include a sight mounting apparatus 806 adapted to receive for attachment to weapon station 800 one or more sighting devices 824. Sighting device 824 may include one or more sensors 826. At least a portion of sighting device 824 attached to sight mounting apparatus 806 may be adapted to rotate about azimuth axis 812 independent of rotation of weapon mounting apparatus 804 about azimuth axis 812, thereby rotating sensor 826 of sighting device 824 about azimuth axis 812. It should be noted that certain sighting devices 824 may not be centered such that azimuth axis 812 would not intersect those sighting devices 824 in the middle of those sighting devices 824; however, for purposes of this description rotation of those sighting devices 824 generally about azimuth axis 812 is considered rotation about azimuth axis 812.

Rotation of the one or more sensors 826 of sighting device 824 about azimuth axis 812 may be driven by a rotational drive mechanism that is housed in sighting device 824, which may be separate from the rotational drive mechanism that drives weapons 810 to rotate about azimuth axis 812. For example, the rotational drive mechanism that drives rotation of the one or more sensors 826 of sighting device 824 about azimuth axis 812 may be housed in a base 830 of sighting device 824. In certain embodiments, the azimuth orientation of weapons 810 and of the one or more sensors 826 of sighting device 824 may be changed independently of one another about common azimuth axis 812.

Thus, weapon station 800 may allow weapon mounting apparatus 804 and a sighting device 824 to be rotated about a common azimuth axis 812 independently of one another. As can be seen, weapon station 800 may allow one or more weapons 810 mounted to weapon mounting apparatus 804 and at least a portion of a sighting device 824 mounted to sight mounting apparatus 806 to be rotated about a common azimuth axis 812 independently of one another.

Sight mounting apparatus 806 may be seated within a cavity of weapon mounting apparatus 804, and particularly within a cavity of body portion 814 of weapon mounting apparatus 804. In certain embodiments, when weapon mounting apparatus 804 rotates about azimuth axis 812, weapon mounting apparatus 804 moves along an outer perimeter of sight mounting apparatus 806. Additionally or alternatively, in certain embodiments, when at least a portion of sighting device 824 attached to sight mounting apparatus 806 rotates about azimuth axis 812 (independent of the rotation of weapon mounting apparatus 804), sighting device 824 may move generally within an interior perimeter of body portion 814, which depending at least in part on the width of shaft 820 may reduce or eliminate the likelihood that the attached sighting device 824 and the one or more attached weapons 810 make physical contact.

The elevational orientation of the one or more sensors 826 of sighting device 824 may be changed through the rotation of at least a portion of sighting device 824 about an elevation axis 828, which may be a different elevation axis than elevation axis 822 (about which weapons 810 rotate). Rotation of the one or more sensors 826 of sighting device 824 about elevation axis 828 may be driven by a rotational drive mechanism that is housed in sighting device 824, which may be separate from the rotational drive mechanism that drives weapons 810 to rotate about elevation axis 822. For example, the rotational drive mechanism that drives rotation of the one or more sensors 826 of sighting device 824 about elevation axis 828 may be housed in base 830 of sighting device 824. In certain embodiments, the elevational orientation of weapons 810 and of the one or more sensors 826 of sighting device 824 may be changed independently of one another about separate elevation axes (822 and 828, respectively).

Figure 9:
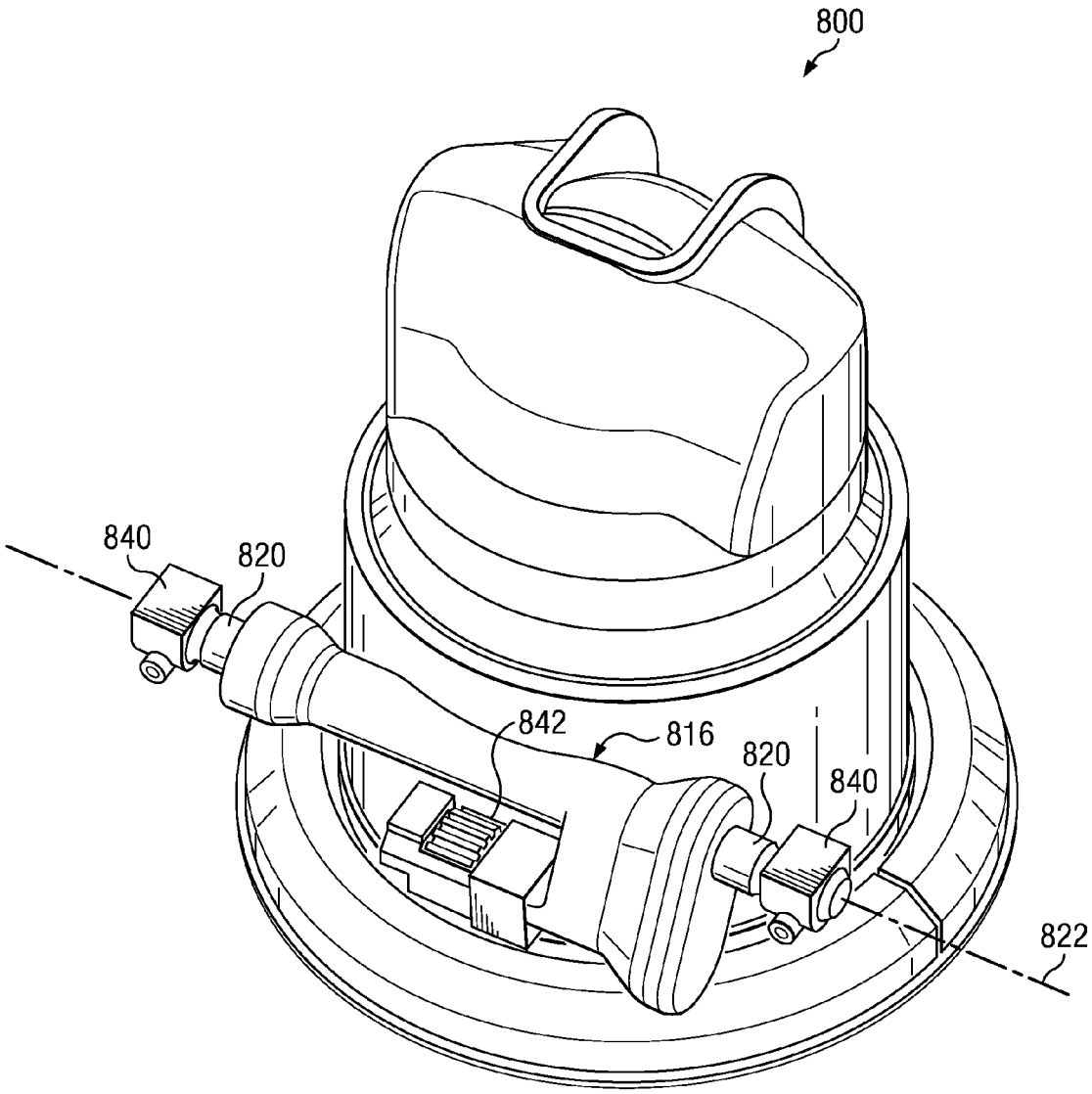
FIG. 9 illustrates a view of the weapon station of FIGS. 8A-8B showing the elevation shaft housing of the weapon station, according to certain embodiments of the present disclosure.

FIG. 9 illustrates a view of the weapon station 800 of FIGS. 8A-8B showing the elevation shaft housing 816 of weapon station 800, according to certain embodiments of the present disclosure. Weapons 810 have been removed to more clearly illustrate certain aspects of elevation shaft housing 816. Elevation shaft housing 816 includes at least a portion of the elevation drive mechanism for changing the elevational orientation of one or more weapons 810 attached to weapon station 800.

Weapon mounts may be attached to knobs 840 at opposing ends of shaft 820. The weapon mounts may allow one or more weapons 810 to be mounted to elevation shaft housing 816. A gear assembly 842 of elevation shaft housing 816 may interact with one or more gear mechanisms housed by body portion 814 of weapon mounting apparatus 804 to drive rotation of weapons 810 attached to elevation shaft housing 816 about elevation axis 822 to modify the elevation orientation of the weapons 810.

Figure 10:
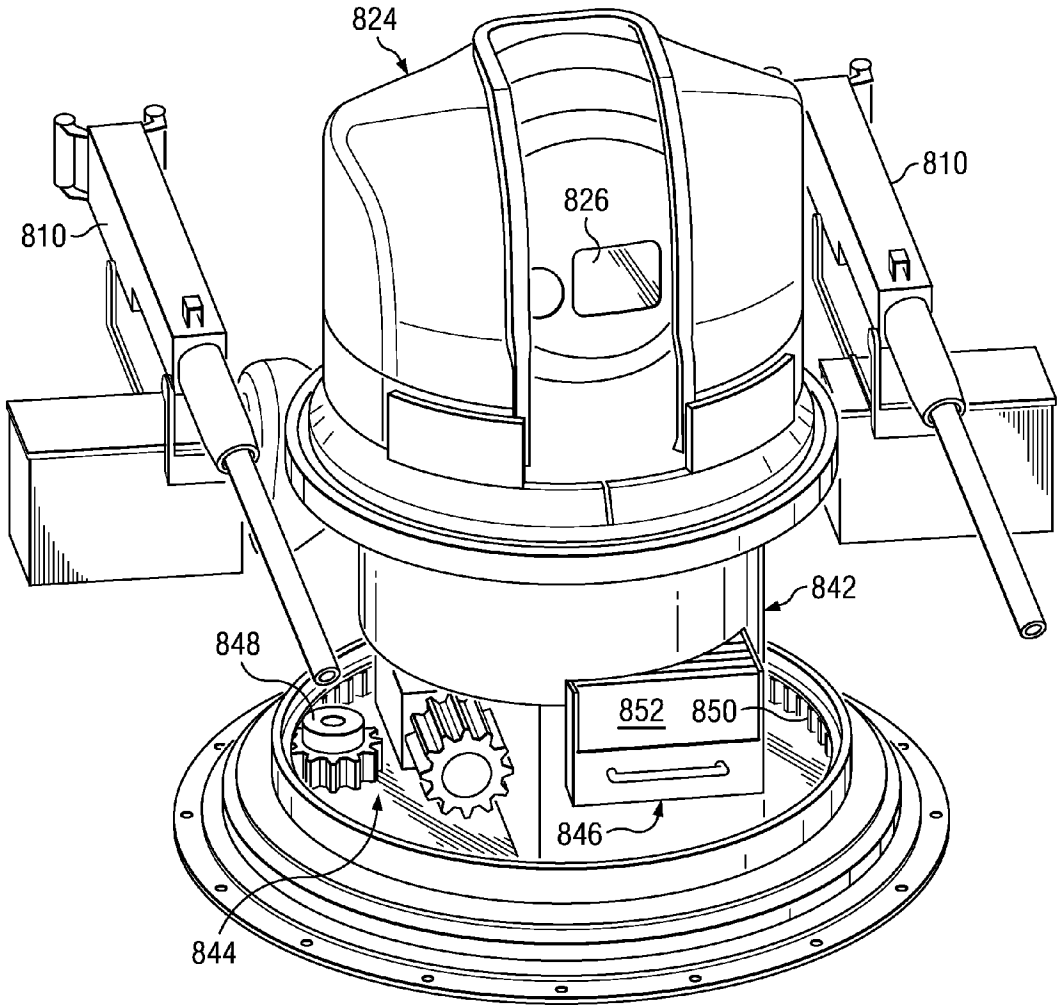
FIG. 10 illustrates the weapon station of FIGS. 8A-8B with the body portion of the weapon mounting apparatus removed to reveal certain drive mechanisms of the weapon station, according to certain embodiments of the present disclosure.

FIG. 10 illustrates weapon station 800 of FIGS. 8A-8B with body portion 814 of weapon mounting apparatus 804 removed to reveal certain drive mechanisms of weapon station 800, according to certain embodiments of the present disclosure. Weapon mounting apparatus 804 includes kingpost structure 842 with an azimuth rotational drive mechanism 844 and a rack 846. Azimuth rotational drive mechanism 844 may be used to rotate a suitable portion of weapon mounting apparatus 804 about azimuth axis 812 (FIG. 8) to change the azimuth orientation of weapons 810. In general, teeth of one or more gears 848 may engage tracks 850 to effect rotation movement of a suitable portion of weapon mounting apparatus 804 (and thereby weapons 810) about azimuth axis 812.

Rack 846 may be used to house one or more modules 852 used by weapon station 800. Rack 846 may house any suitable number of modules 852, according to particular needs and configurations. In certain embodiments, the height of the kingpost structure 842 may affect the number of modules 852 that may be housed in weapon station 800. For example, certain embodiments incorporating a relatively short kingpost structure 842 may be adapted to house up to eight modules 852, for controlling weapon 810 and/or sensor 826 for example. Certain embodiments incorporating a relatively tall kingpost structure 842 may be adapted to house more than eight modules 852 for controlling weapon 810 and/or sensor 826. In certain embodiments, one or more of modules 852 correspond to electronics module 190 described above with reference to FIG. 3.

Inclusion of rack 846 may allow modules 852 used with weapons 810 and/or sensors 826 may be stored in the kingpost structure 842 of weapon station 800 rather than (or in addition to) on the vehicle or other entity on which weapon station 800 is mounted. This may allow weapon station 800 to be used with certain entities without retrofitting those entities with additional items for containing ancillary modules 852 that support operation of weapons 810 and/or sensors 826.

Figure 11:
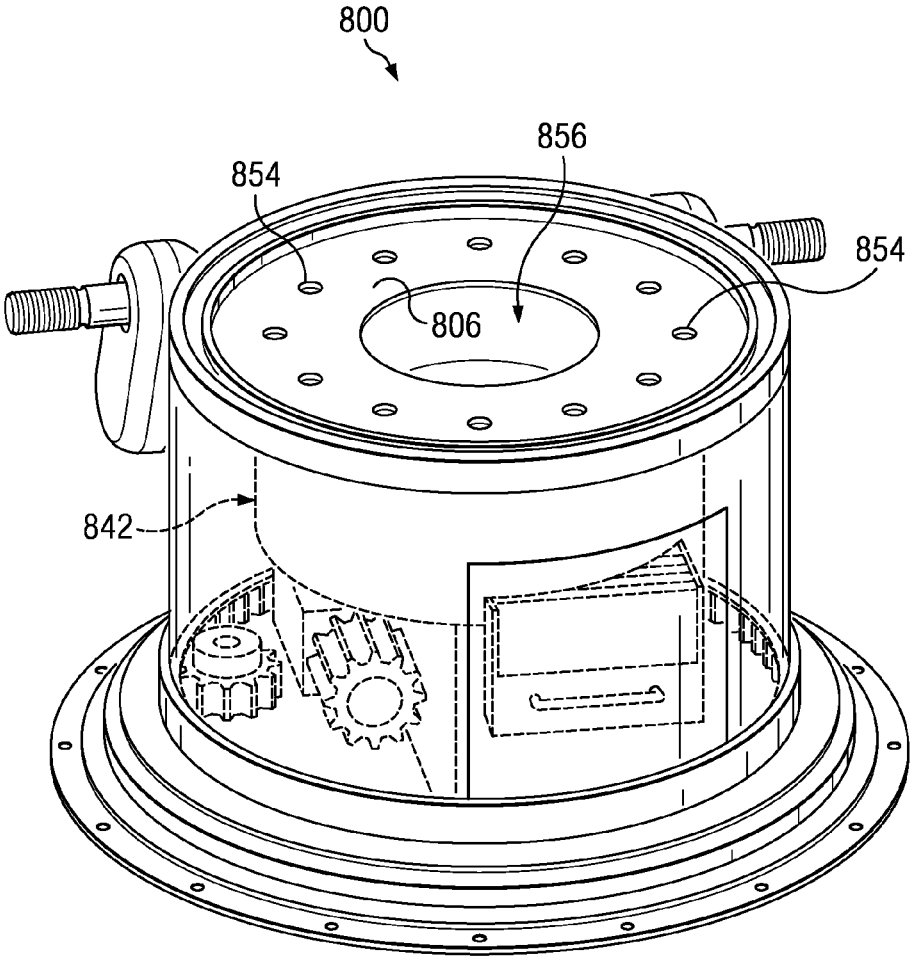
FIG. 11 illustrates the weapon station of FIGS. 8A-8B with the sensor device removed, according to certain embodiments of the present disclosure.

FIG. 11 illustrates weapon station 800 of FIGS. 8A-8B with sensor device 824 removed, according to certain embodiments of the present disclosure. Sight mounting apparatus 806 is visible in greater detail. In certain embodiments, sight mounting apparatus 806 is seated within a cavity of body portion 814 and may be supported at least in part by kingpost structure 842. One or more apertures 854 in sight mounting apparatus 806 may be adapted to receive one or more fasteners for securing sighting device 824 to sight mounting apparatus 806 and thereby to weapon station 800. A cavity 856 of sight mounting apparatus 806 may be adapted to house a portion of sighting device 824 that may extend down into cavity 856 when sighting device 824 is attached to sight mounting apparatus 806. Additionally or alternatively, cavity 856 may provide a path by which to pass one or more electrical connections to sighting device 824.

Figure 12:
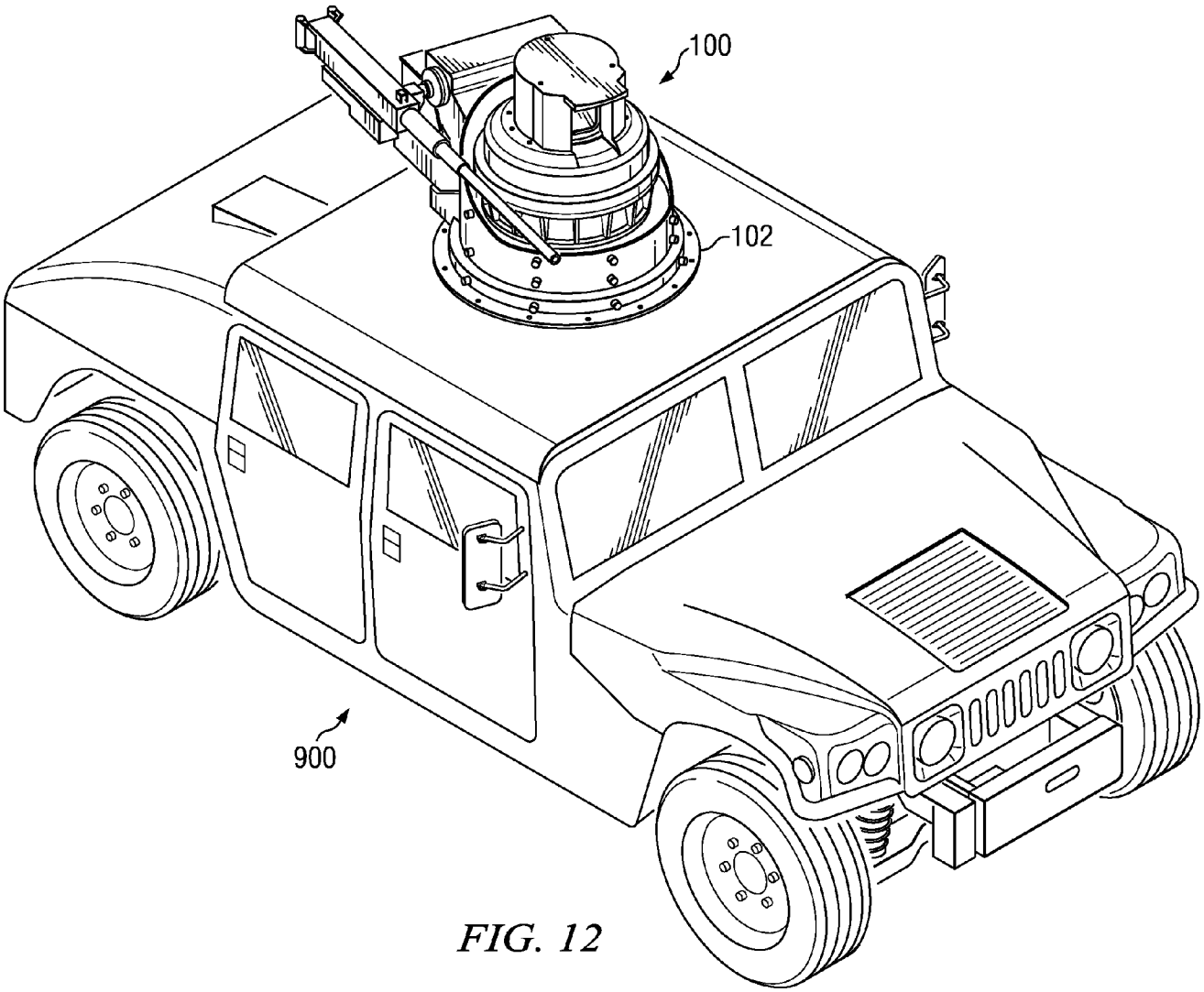
FIG. 12 illustrates an example vehicle with the example weapon station of FIGS. 6A-6B mounted thereon, according to certain embodiments of the present disclosure.

FIG. 12 illustrates an example vehicle 900 with example weapon station 100 mounted thereon, according to certain embodiments of the present disclosure. In the illustrated example, weapon station 100 corresponds to weapon station 100 of FIG. 6A. Although FIG. 12 illustrates a particular type of weapon station 100 being mounted on vehicle 900, the present disclosure contemplates vehicle 900 having any suitable type of weapon station in accordance with the present disclosure mounted thereon, including without limitation any of the embodiments of weapon stations 100 and 800 described herein.

Vehicle 900 in this example is a high mobility multipurpose wheeled vehicle (HUMVEE). Although a particular type of vehicle 900 is illustrated and described, the present disclosure contemplates weapon station 100 (or any other suitable type of weapon station in accordance with the present disclosure) being mounted on any suitable type of vehicle, according to particular needs. Other example vehicles may include an unmanned vehicle, a tank, an armored personnel carrier vehicle, or any other suitable type of vehicle.

In the illustrated example, weapon station 100 is positioned on top of vehicle 900. However, the present disclosure contemplates weapon station 100 being positioned on any suitable portion of vehicle 900.

In certain embodiments, some or all of the components of the various weapon stations described herein may be constructed of a metal or metal alloy. However, the present disclosure contemplates components of these systems being constructed of any suitable material(s), according to particular needs. Additionally, although components of the various weapon stations described herein are illustrated and described as having particular shapes and sizes, the present disclosure contemplates the components of a weapon station in accordance with the present disclosure having any suitable sizes and shapes, according to particular needs.

The present description contemplates weapon station 100/800 having any suitable orientation relative to the ground. For example, weapon station 100/800 may be mounted on a substantially horizontal face of an entity. As another example, weapon station 100/800 may be mounted on a substantially vertical face of an entity. Thus, unless otherwise specified, the names given to various components of weapon stations 100/800 are not meant to imply any particular orientation.

Figure 13:
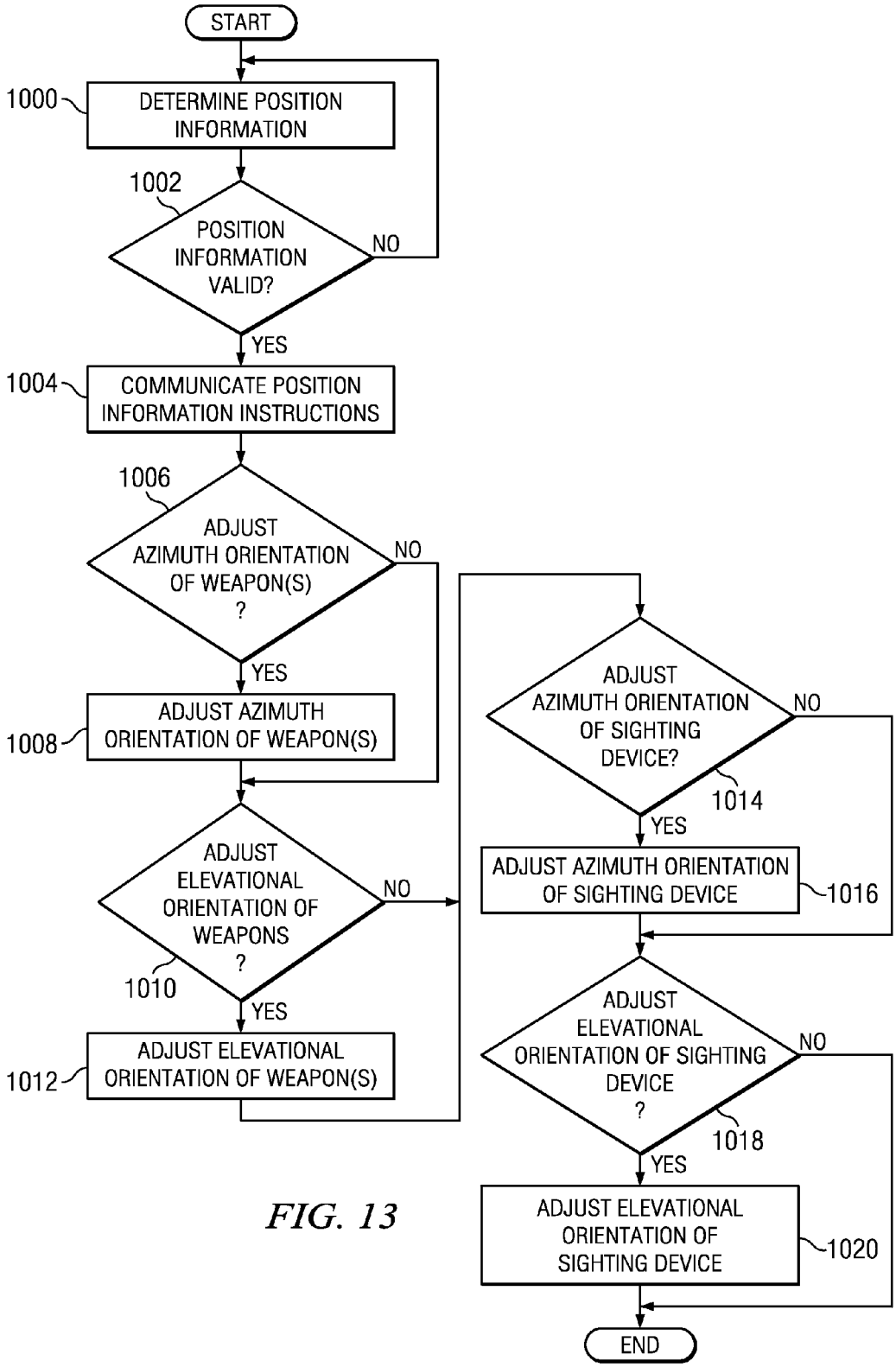
FIG. 13 illustrates an example method for operating a weapon station, according to certain embodiments of the present disclosure.

FIG. 13 illustrates an example method for operating a weapon station, according to certain embodiments of the present disclosure. The example method described with respect to FIG. 13 may be implemented in any suitable combination of software, firmware, and hardware. This example method is described with respect to weapon station 100; however, the present disclosure contemplates this example method being performed using any suitable type of weapon station (e.g., weapon station 400) in accordance with the present disclosure. Additionally, although particular components are described as performing particular steps of the following method, the present disclosure contemplates any suitable component performing these steps as may be appropriate.

At step 1000, operational logic 196 of electronics module 190 may determine position information. In certain embodiments, position information includes information that may be used to describe a desired position of one or more weapons 150 and/or sighting device 160 (and its associated one or more sensors 302). Position information may be determined in any suitable manner, according to particular needs. In certain embodiments, logic 196 may receive information from sighting device 160 (e.g., about the location of one or more targets) and incorporate that received information into the determined position information. Additionally or alternatively, logic 196 may receive position information from a user of electronics module 190 or from any other suitable source. For example, logic 196 may receive and/or determine position information based on information received from sources other than sighting device 160, such as one or more other sighting devices (in addition to or as an alternative to receiving information from sighting device 160).

As just one particular example, sighting device 160 may locate (possibly by rotating one or more sensors of sighting device 160 about azimuth axis 110 and elevation axis 164 independent of rotating the one or more weapons 150 about azimuth axis 110 and/or elevation axis 128) a target for weapons 150, and location information may be provided to operational logic 196. Operational logic 196, possibly in response to a user or other command, may calculate appropriate instructions for causing the one or more weapons 150 to be rotated to the target location.

At step 1002, logic 196 may determine whether the position information determined at step 1000 is valid. A position may be valid or invalid for any suitable reason, according to particular needs. As just one example, certain positions may be invalid due to the presence of invalid targets (e.g., so called "friendlies") at certain locations such that firing at those locations may result in friendly fire. If logic determines at step 1002 that the determined position information is invalid, then in the illustrated embodiment, the method returns to step 1000 for new position information to be determined. In certain other embodiments, the method may simply end in response to a logic 196 determining at step 1002 that the position information is invalid. If logic determines at step 1002 that the determined position information is valid, then the method may proceed to step 1004.

At step 1004, logic 196 may communicate the determined position information as instructions to suitable components of weapon station 100. For example, logic 196 may communicate the instructions via links 198.

At step 1006, it may be determined whether the azimuth orientation of weapon(s) 150 should be adjusted. If not, then the method may proceed to step 1010. If it is determined that the azimuth orientation of weapon(s) 150 should be adjusted, then at step 1008, the azimuth orientation of weapon(s) 150 is adjusted. For example, azimuth rotational drive mechanism 250 may cause weapon mounting apparatus 104 to rotate about azimuth axis 110 to a position reflected in the instructions communicated at step 1004, thereby adjusting the azimuth orientation of weapon(s) 150 to a position reflected in the instructions communicated at step 1004. As described above, weapon mounting apparatus 104 may rotate about azimuth axis 110 independent of rotation of one or more sensors 302 of sighting device 160 about azimuth axis 110.

At step 1010, it may be determined whether the elevational orientation of weapon(s) 150 should be adjusted. If not, then the method may proceed to step 1014. If it is determined that the elevational orientation of weapon(s) 150 should be adjusted, then at step 1012, the elevational orientation of weapon(s) 150 is adjusted. For example, elevation rotational drive mechanism 200 may cause shaft 122 to rotate about elevation axis 128 to a position reflected in the instructions communicated at step 1004, thereby adjusting the elevational orientation of weapon(s) 150 to a position reflected in the instructions communicated at step 1004. As described above, shaft 122 may rotate about elevation axis 128 independent of rotation of one or more sensors 302 sighting device 160 about its own elevation axis 164.

At step 1014, it may be determined whether the azimuth orientation of sighting device 160 should be adjusted. If not, then the method may proceed to step 1018. If it is determined that the azimuth orientation of sighting device 160 should be adjusted, then at step 1016, the azimuth orientation of sighting device 160 is adjusted. For example, an azimuth rotational drive mechanism of sighting device 160 may cause sighting device 160 to rotate about azimuth axis 110 to a position reflected in the instructions communicated at step 1004, thereby adjusting the azimuth orientation of the one or more sensors 302 to a position reflected in the instructions communicated at step 1004. As described above, sighting device 160 may rotate about azimuth axis 110 independent of rotation of weapon mounting apparatus 104 about azimuth axis 110.

At step 1018, it may be determined whether the elevational orientation of sighting device 160 should be adjusted. If not, then the method may end. If it is determined that the elevational orientation of sighting device 160 should be adjusted, then at step 1020, the elevational orientation of sighting device 160 is adjusted. For example, an elevation rotational drive mechanism of sighting device 160 may cause sighting device 160 to rotate about elevation axis 164 to a position reflected in the instructions communicated at step 1004, thereby adjusting the elevational orientation of the one or more sensors 302 of sighting device 160 to a position reflected in the instructions communicated at step 1004. As described above, sighting device 160 may rotate about elevation axis 164 independent of rotation of shaft 122 about its own elevation axis 128.

In certain embodiments, the decisions at steps 1006, 1010, 1014, and 1018 are not explicit decisions made by a particular component of weapon station 100 but are simply realized by particular components of weapon station 100 receiving the instructions communicated at step 1004. Additionally or alternatively, logic 196 may perform these determinations prior to communicating instructions at step 1004 as part of determining where to communicate the instructions.

Although the present disclosure describes or illustrates particular operations as occurring in a particular order, the present disclosure contemplates any suitable operations occurring in any suitable order. Moreover, the present disclosure contemplates any suitable operations being repeated one or more times in any suitable order. Although the present disclosure describes or illustrates particular operations as occurring in sequence, the present disclosure contemplates any suitable operations occurring at substantially the same time, where appropriate.

Certain embodiments of the present disclosure may provide one or more technical advantages. For example, the independent rotation of weapon mounting apparatus 104/804 and the one or more sensors 302/826 of sighting device 160/824 about a common azimuth axis 110/812 may allow independent establishment of an azimuth orientation of both one or more weapons 150/810 attached to the weapon mounting apparatus 104/804 and the one or more sensors 302/826 of the sighting device 160/824. As another example, the independent rotation of the weapon mounting apparatus 104/804 and the one or more sensors 302/826 of a sighting device 160/824 about different elevation axes 128/164, 822/828 may allow independent establishment of an elevational orientation of both one or more weapons 150/810 attached to the weapon mounting apparatus 104/804 and the one or more sensors 302/826 of the sighting device 160/824. As another example, certain embodiments may allow the elevational orientation of one or more weapons 150/810 and one or more sensors 302/826 to be established both independently of one another (about different elevation axes 128/164, 822/828), as well as the independent establishment of an azimuth orientation of one or more weapons 150/810 and one or more sensors 302/826.

As just one example scenario, a sighting device 160/824 may be able to rotate its one or more sensors 302/826 about both the common azimuth axis 110/812 and its own elevation axis 164/828 as sighting device 160/824 searches for potential targets, while the one or more weapons 150/810 attached to the weapon mounting apparatus 104/804 remain fixed in a stowage position. This may allow the weapon station 100/800 to avoid pointing weapons 150/810 at unintended targets or may allow the sighting device 160/824 to search for targets in a more discrete manner.

In certain embodiments, the offset position of the attached weapons 150/810 from the common azimuth axis 110/812 may provide one or more advantages. For example, the offset position of the weapon 150/810 may reduce or eliminate obstruction of the line-of-sight of the one or more sensors 302/826 of the sighting device 160/824 by the attached weapons 150/810. As another example, the offset position of the one or more attached weapons 150/810 may provide a relatively smaller footprint or keep-out-zone to the weapon station than would otherwise be provided by a weapon mount that is configured co-axially with one or more sensors of a sighting device attached to a weapon station. In certain embodiments, weapons 150/810 may be orientated at numerous elevational angles without interfering with the field-of-regard of sensors 302/826 of sighting device 160/824.

In certain embodiments, driving rotational movement of weapons 150 and sighting device 160 using separate drive mechanisms may allow for the shock impulse of firing one or more of the weapons 150 to be attenuated, which may reduce or eliminate the impact of the shock on the sighting device 160. This may substantially prevent (or at least reduce) the effects of the shock from being seen on a display associated with viewing output of sighting device 160.

Although the present disclosure has been described with several embodiments, a myriad of changes, variations, alterations, transformations, and modifications may be suggested to one skilled in the art, and it is intended that the present disclosure encompass such changes, variations, alterations, transformation, and modifications as they fall within the scope of the appended claims.

What is claimed is:

1. A weapon station, comprising:

a weapon mounting apparatus comprising:

a first rotational drive mechanism that rotates the weapon mounting apparatus about an azimuth axis; and a weapon mount located at a position offset from the azimuth axis; and a sight mounting apparatus coupled to the weapon mounting apparatus and comprising:

a sighting device mount for retaining a sighting device that includes one or more sensors; and a second rotational drive mechanism that rotates the sight mounting apparatus about the azimuth axis independently of rotational movement of the weapon mounting apparatus about the azimuth axis, the azimuth axis about which the weapon mounting apparatus and the sight mounting apparatus rotate being the same axis; and wherein the weapon mounting apparatus comprises a shaft that retains the weapon mount, the weapon mount adapted to receive for attachment a weapon, the shaft being offset from and substantially perpendicular to the azimuth axis and adapted to rotate about a first elevation axis using a third rotational drive mechanism; and wherein the weapon mounting apparatus further comprises:

a body portion; and an elevation shaft housing extending from an outer surface of the body portion, the elevation shaft housing containing a portion of the shaft, wherein ends of the shaft extend through apertures in the elevation shaft housing.

2. The weapon station of claim 1, wherein the first and third drive mechanisms are housed at least in part by the elevation shaft housing.

3. The weapon station of claim 1, wherein the third rotational drive mechanism comprises one or more motors coupled to the shaft and operable to power rotation of the shaft about the first elevation axis.

4. A weapon station, comprising:

a weapon mounting apparatus comprising:

a first rotational drive mechanism that rotates the weapon mounting apparatus about an azimuth axis; and a weapon mount located at a position offset from the azimuth axis; and a sight mounting apparatus coupled to the weapon mounting apparatus and comprising:

a sighting device mount for retaining a sighting device that includes one or more sensors; and a second rotational drive mechanism that rotates the sight mounting apparatus about the azimuth axis independently of rotational movement of the weapon mounting apparatus about the azimuth axis, the azimuth axis about which the weapon mounting apparatus and the sight mounting apparatus rotate being the same axis; and wherein:

the weapon mounting apparatus comprises a body portion driven to rotate about the azimuth axis by the first rotational drive mechanism, the body portion circumscribing a cylindrical cavity; and the sight mounting apparatus is positioned concentrically with the body portion within the cylindrical cavity of the body portion and driven to rotate therein by the second rotational drive mechanism.

5. The weapon station of claim 4, further comprising:

a base; and wherein the weapon mounting apparatus is coupled to the base and the weapon mounting apparatus further comprises:

a third rotational drive mechanism that rotates the weapon mount about a first elevation axis; and wherein the sight mounting apparatus further comprises:

a fourth rotational drive mechanism that rotates one or more of the sensors about a second elevation axis, the second elevation axis being different than the first elevation axis and the fourth rotational drive mechanism being different than the third rotational drive mechanism to change an elevational orientation of the weapon mount independently of changing an elevational orientation of the one or more of the sensors of the sighting device.

6. The weapon station of claim 5, wherein the weapon mounting apparatus comprises a shaft that retains the weapon mount at a first end of the shaft and a second weapon mount at a second end of the shaft, a longitudinal axis of the shaft offset from and substantially perpendicular to the azimuth axis and the longitudinal axis of the shaft and the first elevation axis being the same.

7. The weapon station of claim 5, further comprising an electronics module operable to:

determine position information specifying a desired position of one or more weapons attached to the weapon mounting apparatus, the desired position comprising an azimuth orientation and an elevational orientation for the one or more weapons;

cause the weapon station to implement the desired position specified in the determined position information.

8. The weapon station of claim 7, wherein the electronics module is located internal to the weapon station.

9. The weapon station of claim 4, wherein the first rotational drive mechanism used for rotating the weapon mounting apparatus about the azimuth axis comprises:

one or more gears operable to, when rotated, cause the weapon mounting apparatus to rotate about the azimuth axis; and one or more motors operable to drive rotation of the one or more gears.

10. The weapon station of claim 4, further comprising a base, the weapon mounting apparatus coupled to the base and rotates about the azimuth axis relative to the base, the base adapted to be non-rotationally coupled to an entity.

11. A weapon station, comprising:

a weapon mounting apparatus comprising:

a first rotational drive mechanism that rotates the weapon mounting apparatus about an azimuth axis; and a weapon mount located at a position offset from the azimuth axis; and a sight mounting apparatus coupled to the weapon mounting apparatus and comprising:

a sighting device mount for retaining a sighting device that includes one or more sensors; and a second rotational drive mechanism that rotates the sight mounting apparatus about the azimuth axis independently of rotational movement of the weapon mounting apparatus about the azimuth axis, the azimuth axis about which the weapon mounting apparatus and the sight mounting apparatus rotate being the same axis; and wherein the weapon mounting apparatus further comprises a kingpost, the kingpost aligned about the azimuth axis and the kingpost having a cavity for housing one or more electronics modules.

12. The weapon station of claim 11, wherein the weapon station is attached to one of a vehicle or a fixed structure.

* * * * *